US007008364B2

(12) United States Patent
Ochsenbauer

(10) Patent No.: US 7,008,364 B2
(45) Date of Patent: Mar. 7, 2006

(54) SHEET FOLDING APPARATUS AND METHOD

(75) Inventor: Edward R. Ochsenbauer, Ashland, WI (US)

(73) Assignee: C.G. Bretting Manufacturing Company, Inc., Ashland, WI (US)

( * ) Notice: Subject to any disclaimer, the term of this patent is extended or adjusted under 35 U.S.C. 154(b) by 125 days.

(21) Appl. No.: 10/259,167

(22) Filed: Sep. 27, 2002

(65) Prior Publication Data

US 2004/0063559 A1 Apr. 1, 2004

(51) Int. Cl.
*B31F 1/08* (2006.01)

(52) U.S. Cl. ..... 493/427; 493/424; 493/426; 493/442; 493/450; 270/42

(58) Field of Classification Search ..... 493/405, 493/416, 422, 424, 425, 426, 442, 450, 454, 493/427; 270/42, 16, 69
See application file for complete search history.

(56) References Cited

U.S. PATENT DOCUMENTS

| | | | |
|---|---|---|---|
| 821,562 | A | 5/1906 | Wheeler |
| 837,892 | A | 12/1906 | Wheeler |
| 839,521 | A | 12/1906 | Spoerl |
| 843,781 | A | 2/1907 | Wheeler |
| 863,958 | A | 8/1907 | Wheeler |
| 940,933 | A | 11/1909 | Klein |
| 1,053,914 | A | 2/1913 | Hudson |
| 1,228,835 | A | 6/1917 | Schuchart |
| 1,358,665 | A | 11/1920 | Wennerblad |
| 1,423,276 | A | 7/1922 | Straubel |
| 1,561,908 | A | 11/1925 | Cannard et al. |
| 1,566,079 | A | 12/1925 | Christman, Jr. et al. |
| 1,595,992 | A | 8/1926 | Cannard et al. |
| 1,761,517 | A | 6/1930 | Christman |
| 1,871,301 | A | 8/1932 | Campbell |
| 1,886,312 | A | 11/1932 | Stanton |
| 1,966,885 | A | 7/1934 | Crafts |
| 1,974,149 | A | 9/1934 | Christman |
| 2,092,952 | A | 9/1937 | Campbell |
| 2,631,846 | A | 3/1953 | Sabee |
| 2,642,279 | A | 6/1953 | Teall |
| 2,872,186 | A | 2/1959 | Raybuck |
| 2,929,624 | A | 3/1960 | Brooker |
| 3,034,780 | A | 5/1962 | Stelling, Jr. et al. |
| 3,150,871 | A | 9/1964 | Boblit, Jr. et al. |
| 3,163,413 | A | 12/1964 | Franke et al. |
| 3,178,171 | A | 4/1965 | Springer et al. |
| 3,195,883 | A | 7/1965 | Southwell et al. |
| 3,211,448 | A | 10/1965 | Stoothoff |
| 3,279,792 | A | 10/1966 | Kostal et al. |

(Continued)

FOREIGN PATENT DOCUMENTS

| | | |
|---|---|---|
| AT | 219396 | 1/1962 |

(Continued)

*Primary Examiner*—Louis K. Huynh
*Assistant Examiner*—Christopher Harmon
(74) *Attorney, Agent, or Firm*—Michael Best & Friedrich LLP

(57) ABSTRACT

In some embodiments of the present invention, a method and apparatus for folding sheets are disclosed in which single transverse folds are created by vacuum rolls in one operational mode and double transverse folds are created by vacuum rolls in another operational mode. The folder can have a low profile in which the axes of various elements and assemblies in the folder are located within height ranges relative to the height of a folding roll axis in the folder.

37 Claims, 14 Drawing Sheets

U.S. PATENT DOCUMENTS 3,291,476 A 12/1966 Greiner et al.
3,307,844 A 3/1967 Stults
3,314,340 A 4/1967 Bishop
3,338,575 A 8/1967 Nystrand et al.
3,351,215 A 11/1967 Kitch
3,401,928 A 9/1968 Frick
3,466,029 A 9/1969 Jensen et al.
3,489,406 A 1/1970 Nystrand
3,490,762 A 1/1970 Nystrand
3,514,047 A 5/1970 De Mallie et al.
3,536,317 A 10/1970 Billet
3,557,688 A 1/1971 Hartbauer et al.
3,572,681 A 3/1971 Nystrand
3,624,723 A 11/1971 Cannon
3,647,201 A 3/1972 Kemp
3,679,094 A 7/1972 Nissen et al.
3,679,095 A 7/1972 Nissen et al.
3,689,061 A 9/1972 Nystrand
3,709,077 A 1/1973 Trogan et al.
3,784,187 A 1/1974 Takayanagi et al.
3,784,188 A 1/1974 De Ligt
3,817,514 A 6/1974 Nissen et al.
3,834,689 A 9/1974 Lee et al.
3,841,620 A 10/1974 Lee et al.
3,844,189 A 10/1974 Jardine
3,866,905 A 2/1975 Trogan et al.
3,869,095 A 3/1975 Diltz
3,947,013 A 3/1976 Nystrand
3,948,504 A 4/1976 Woessner et al.
3,972,486 A 8/1976 Straujups
3,980,289 A 9/1976 Harm
3,991,994 A 11/1976 Farish
4,000,863 A 1/1977 Straujups
4,052,048 A 10/1977 Shirasaka
4,061,325 A 12/1977 Marcalus et al.
4,070,014 A 1/1978 Takahashi
4,131,272 A 12/1978 Hartnig
4,163,548 A 8/1979 Nystrand
4,190,242 A 2/1980 Bolza-Schunemann
4,203,584 A 5/1980 Smaw
4,204,669 A 5/1980 Nystrand
4,205,836 A 6/1980 Nystrand
4,254,947 A 3/1981 Trogan
4,270,744 A 6/1981 Trogan
4,279,410 A 7/1981 Bolza-Schunemann
4,279,411 A 7/1981 Nystrand
4,283,973 A 8/1981 Spencer
4,285,621 A 8/1981 Spencer
4,290,592 A 9/1981 Kastner
4,325,475 A 4/1982 Spalding
4,332,582 A 6/1982 Hertrich
4,332,583 A 6/1982 Stemmler et al.
4,349,185 A 9/1982 Small et al.
4,392,844 A 7/1983 Fulk et al.
4,396,336 A 8/1983 Malamood
4,406,650 A 9/1983 Felix
4,428,543 A 1/1984 Kuhn
4,471,955 A 9/1984 Bradley et al.
4,475,730 A 10/1984 Trogan
4,494,741 A 1/1985 Fischer et al.
4,508,279 A 4/1985 Tokuno et al.
4,508,527 A 4/1985 Uno et al.
4,625,957 A 12/1986 DuFresne
RE32,331 E 1/1987 Fulk et al.
4,650,447 A 3/1987 Meschi
4,673,382 A 6/1987 Buck et al.
4,691,908 A 9/1987 Bradley
4,695,005 A 9/1987 Gietman, Jr.
4,700,939 A 10/1987 Hathaway
4,717,134 A 1/1988 Iida et al.
4,717,135 A 1/1988 Hathaway
4,721,295 A 1/1988 Hathaway
4,723,390 A 2/1988 Duke
4,725,469 A 2/1988 Summerfield
4,751,807 A 6/1988 Couturier
4,765,604 A 8/1988 Trogan
4,770,402 A 9/1988 Couturier
4,778,441 A 10/1988 Couturier
4,824,426 A 4/1989 DuFresne
4,826,095 A 5/1989 Wywialowski
4,842,574 A 6/1989 Noble et al.
4,874,158 A 10/1989 Retzloff
4,892,119 A 1/1990 Hugo et al.
4,914,997 A 4/1990 Belvederi
4,917,665 A 4/1990 Couturier
4,932,599 A 6/1990 Doerfel
4,962,897 A 10/1990 Bradley
4,988,051 A 1/1991 Welschlau et al.
5,005,816 A 4/1991 Stemmler et al.
5,030,311 A 7/1991 Michael et al.
5,040,738 A 8/1991 Biagiotti
5,067,698 A 11/1991 Stemmler
5,072,919 A 12/1991 Schneider et al.
5,088,707 A 2/1992 Stemmler
5,104,055 A 4/1992 Buxton
5,137,225 A 8/1992 Biagiotti
5,147,273 A 9/1992 Rottmann et al.
5,150,848 A 9/1992 Consani
5,226,611 A 7/1993 Butterworth et al.
5,269,744 A 12/1993 Moll
5,299,793 A 4/1994 Couturier
5,310,398 A 5/1994 Yoneyama
5,348,527 A 9/1994 Beckwith
5,425,697 A 6/1995 Lanvin
5,487,718 A 1/1996 Staniszewski
5,520,603 A 5/1996 Bluthardt et al.
5,554,094 A 9/1996 Viens
5,702,341 A 12/1997 Keilhau
5,868,276 A 2/1999 Loppnow et al.
5,904,277 A 5/1999 Niedermeyer
5,992,682 A 11/1999 Loppnow et al.
6,024,685 A * 2/2000 Kirsch ..... 493/396
6,045,002 A 4/2000 Wierschke
6,168,848 B1 1/2001 Heath
6,206,817 B1 3/2001 Sette et al.
6,235,156 B1 5/2001 Pullinen et al.
6,238,328 B1 5/2001 Loppnow et al.
6,245,198 B1 6/2001 Kinnunen et al.
6,261,415 B1 7/2001 Johansson et al.
6,274,000 B1 8/2001 Koivukunnas et al.
6,286,712 B1 9/2001 Craig et al.
6,446,961 B1 * 9/2002 Foret et al. ..... 271/259

FOREIGN PATENT DOCUMENTS

DE 372031 3/1923
DE 442935 4/1927
DE 719833 4/1942
DE 2 123 243 11/1972
EP 1 118 568 A2 7/2001
GB 321873 11/1929
GB 1 479 299 7/1977
IT 646301 7/1962
SE 116974 8/1946
WO WO 98/45197 10/1998
WO WO 98/45199 10/1998
WO WO 98/47709 10/1998
WO WO 98/47803 10/1998
WO WO 98/47804 10/1998

* cited by examiner 20
24
28
32
34
38
42
46
50
54
58
62
66
70
74
78
82
86
98
100
102
106
110
118
122
126
130
134
142
162
174
182
186
188
189
194
198
202
206
210
214
218
222
226
228
230
234
238

SHEET FOLDING APPARATUS AND METHOD

BACKGROUND OF THE INVENTION

Conventional sheet folding machines exist in a variety of shapes and sizes, and are designed to perform a variety of different folds on sheet products. Typical products that are commonly folded include napkins, tissues, hand towels, and the like.

Typically, conventional folders perform folding operations in a variety of stages and at a variety of different locations within the folder. These folders tend to be relatively large machines that consume a large quantity of valuable space within manufacturing facilities. The space consumed includes both ground space and overhead space—both of which are valuable and limited in most manufacturing facilities.

Many conventional folders also are designed to produce a particular type of folded product (i.e., having a particular type of fold). In order for conventional folders to perform varying types of folds, such folders must typically be retrofitted or partially disassembled and reassembled. Such changeover can consume valuable operating time and money, and therefore is often less attractive than purchasing different folders for producing different types of folded product. However, both of these options are expensive and inefficient.

Sheet folders can require maintenance from time to time, which can prove to be difficult due to the significant height, width, and layout of conventional folders. Ladders, scissor lifts, or other equipment can be necessary to access many areas of the folder, thereby increasing maintenance costs and time, and increasing the opportunities for injuries during maintenance and operation of the folders.

SUMMARY OF THE INVENTION

Some embodiments of the present invention provide a folder including a first folding roll having a blade for cutting a web of material into sheets, a second folding roll having at least one vacuum port through which vacuum can be selectively supplied to retain the sheets on the second folding roll, and a third folding roll having at least one vacuum port through which vacuum can be selectively supplied to retain the sheets to the third folding roll, wherein the first and second folding rolls define a first nip therebetween and the second and third folding rolls define a second nip therebetween. In such embodiments, the first and second folding rolls are rotatable to advance sheets from the first nip through the second nip and to create folds in sheets passed through the first nip by vacuum selectively supplied to the at least one vacuum port in the second folding roll, and the second and third folding rolls are rotatable to create folds in sheets passed through the second nip by vacuum selectively supplied to the vacuum ports in the second and third folding rolls. Such folders can have a first mode of operation in which vacuum is selectively supplied to the first, second, and third folding rolls to create a first fold in sheets passed through the first nip and a second fold in sheets passed through the second nip, and a second mode of operation in which a single fold is created in sheets passed through the first and second nips.

Other embodiments of the present invention provide a folder for folding a sheet of material, wherein the folder includes a first folding roll rotatable about a first axis, a second folding roll adjacent to the first folding roll and rotatable about a second axis, and a third folding roll adjacent to the second folding roll and rotatable about a third axis, the first and second folding rolls defining a first nip therebetween and the second and third folding rolls define a second nip therebetween. In such embodiments, the folder also includes a first valve operable to selectively supply vacuum to a surface of the second folding roll to draw the sheet of material to the second folding roll, wherein the sheet is at least partially transferable from the first folding roll to the second folding roll to provide the sheet with a first fold, and a second valve operable to selectively supply vacuum to a surface of the third folding roll to draw the sheet of material to the third folding roll, wherein the sheet is at least partially transferable from the second folding roll to the third folding roll to provide the sheet with a second fold. The second valve can be controllable to draw the sheet from the second roll in a first state and to leave the sheet on the second roll in a second state.

In other embodiments of the present invention a folder is provided for folding a sheet of material, and includes a first folding roll, a second folding roll adjacent the first folding roll, a third folding roll adjacent the second folding roll, a first nip defined between the first and second folding rolls, a second nip defined between the second and third folding rolls, a first vacuum valve coupled to the second folding roll and operable to selectively supply vacuum to a surface of the second folding roll, and a second vacuum valve coupled to the third folding roll and operable to selectively supply vacuum to a surface of the third folding roll. The folder can have a first state in which vacuum is supplied by the first vacuum valve to the second folding roll to generate sheets having single transverse folds exiting the folder, and a second state in which vacuum is supplied by the first and second vacuum valves to the second and third folding rolls, respectively, to generate sheets having double transverse folds exiting the folder.

Some embodiments of the present invention provide a method of folding sheets of material, wherein the method includes retaining sheets upon a surface of a first folding roll, advancing the sheets upon the surface of the first folding roll to a first nip defined between the first folding roll and a second folding roll adjacent the first folding roll, supplying vacuum to a surface of the second folding roll, transferring the sheets from the first folding roll to the second folding roll via the vacuum supplied to the surface of the second folding roll, folding each sheet by transferring the sheets from the first folding roll to the second folding roll, advancing the folded sheets upon the surface of the second folding roll to a second nip defined between the second folding roll and a third folding roll, and passing the folded sheets through the second nip between the second folding roll and the third folding roll, wherein the folded sheets are retained on the second folding roll without being drawn to the third folding roll. Such methods also include supplying vacuum to a surface of the third folding roll, drawing other sheets from the second folding roll to the third folding roll, releasing the other sheets from the third folding roll, and folding each of the other sheets by drawing and releasing the other sheets by the third folding roll.

In some embodiments of the present invention, a method of folding sheets of material includes retaining sheets upon a surface of a first folding roll, advancing the sheets upon the surface of the first folding roll to a first nip defined between the first folding roll and a second folding roll adjacent the first folding roll, supplying vacuum to a surface of the second folding roll, transferring the sheets from the first folding roll to the second folding roll via the vacuum supplied to the surface of the second folding roll, wherein the sheets are transferred to the second folding roll without being folded, advancing the sheets upon the surface of the second folding roll to a second nip defined between the second folding roll and a third folding roll, supplying vacuum to a surface of the third folding roll, drawing the sheets from the second folding roll to the third folding roll, releasing the sheets from the third folding roll, folding each of the sheets by drawing and releasing the sheets by the third folding roll, supplying vacuum to the surface of the first folding roll, transferring other sheets from the first folding roll to the second folding roll via the vacuum supplied to the surface of the second folding roll, folding each of the other sheets by transferring the other sheets from the first folding roll to the second folding roll, advancing the other sheets upon the surface of the second folding roll to the second nip between the second folding roll and the third folding roll, supplying vacuum to the surface of the third folding roll, drawing the other sheets from the second folding roll to the third folding roll, releasing the other sheets from the third folding roll, and folding each of the other sheets again by drawing and releasing the sheets by the third folding roll.

Other embodiments of the present invention provide a folder for folding a sheet of material, the folder being supportable on a ground surface and having an unwinding stand for rotatably supporting a roll of wound material about a first axis located a first vertical distance from the ground surface, a first folding roll, and a second folding roll rotatable about a second axis located a second vertical distance from the ground surface, whereby the second vertical distance is no greater than 1.2 times the first vertical distance. The first and second folding rolls define a first nip therebetween, and are rotatable to create folds in sheets passing through the first nip.

In other embodiments of the present invention, a folder for folding a sheet of material is supportable on a ground surface and has an unwinding stand for rotatably supporting a roll of wound material about a first axis located a first vertical distance from the ground surface, a first folding roll, and a second folding roll rotatable about a second axis located a second vertical distance from the ground surface, whereby the first vertical distance is no greater than 1.3 times the second vertical distance. The first and second folding rolls have a nip therebetween and are rotatable to create folds in sheets passing through the first nip.

In still other embodiments of the present invention, a folder for folding sheets of material is supportable on a ground surface and has a folding roll rotatable about a first axis located a first vertical distance from the ground surface and at least partially assisting in creating a fold in the sheets, and a starwheel rotatable about a second axis and operable to stack the sheets, the second axis being located a second vertical distance from the ground surface, wherein the second vertical distance is no greater than the first vertical distance.

Further objects and advantages of the present invention, together with the organization and manner of operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

DETAILED DESCRIPTION OF THE PREFERRED EMBODIMENTS

Figures 1A, 1B:
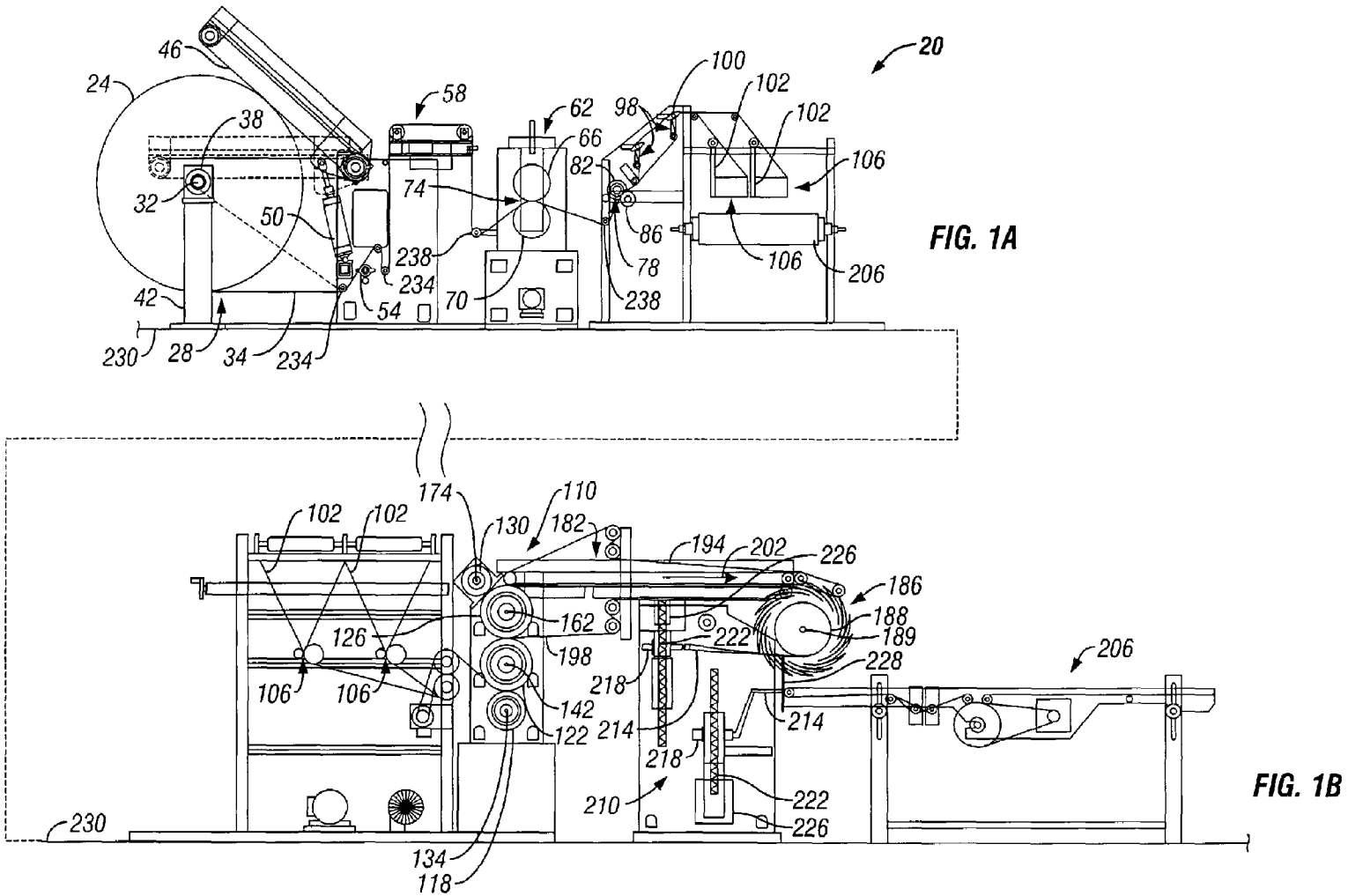
FIG. 1A is a front elevational view of a folder according to an embodiment of the present invention.
FIG. 1B is a side elevational view of the folder in FIG. 1A, in which some of the elements illustrated in FIG. 1A are not shown for purposes of clarity.

FIGS. 1A and 1B illustrate a folder 20 according to an exemplary embodiment of the present invention. The illustrated folder design can be employed to product found in any sheet form (such as sheeting found in any width, strips, webs, and the like) and comprising any material or combinations of material, such as paper, foil, plastic and other synthetic materials, tissue, fabric, and the like as described above. The folder 20 can operate to fold and produce a large number of different products, such as napkins, paper towels, tissues, cards, folders, wrappers for merchandise or other items, and the like.

In the illustrated embodiment, the folder 20 converts a roll 24 of material into a finished product. In some embodiments of the present invention, the folder 20 can convert material found in other forms. For example, the folder 20 can be connected to a downstream end of a processing machine that prepares web material for the folding operations in the folder 20, and can directly receive a web of material from the processing machine. The upstream processing machine can be a papermaking machine, a coater, a coloring machine, a printing machine, an embosser, and the like. As used herein and in the appended claims, the term "web" encompasses any type of sheet material (including those described above) that can be cut into sheet form and folded to produce folded product. Exemplary folded products include without limitation napkins, paper towels, tissues, cards, folders, wrappers for merchandise or other items, and the like.

Figure 2:
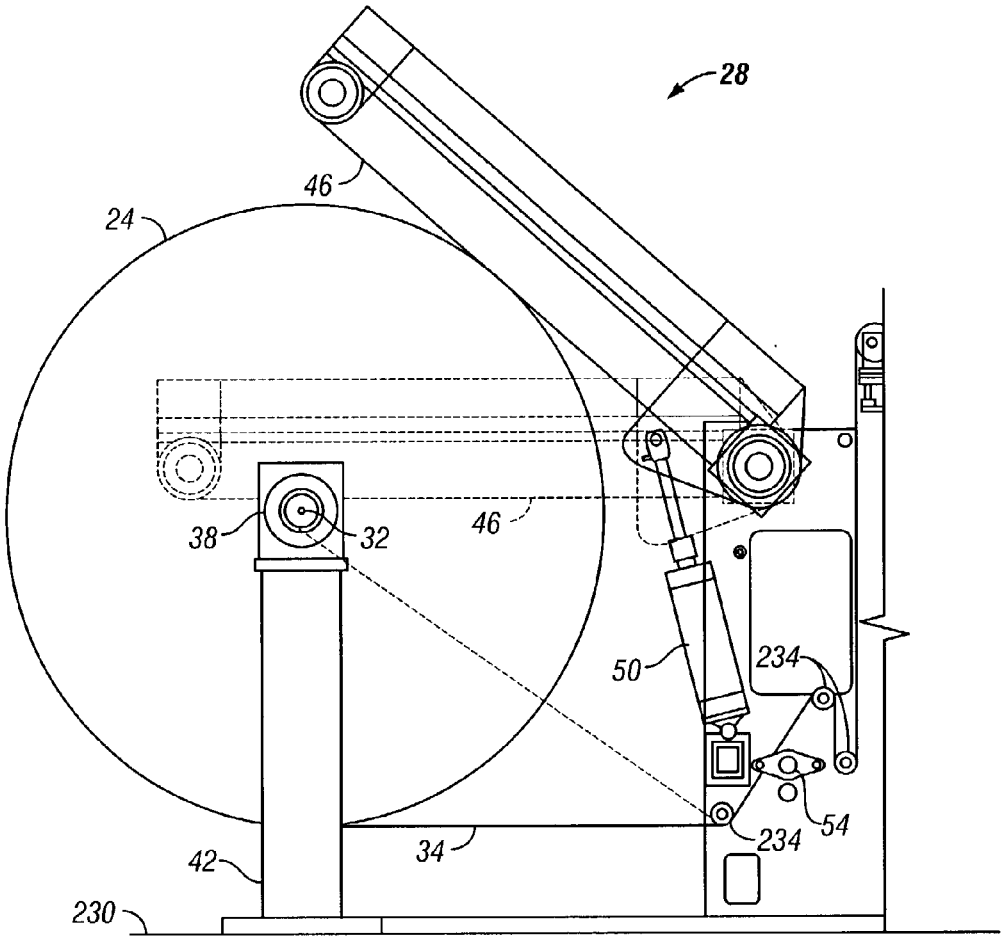
FIG. 2 is a view of the unwind stand of the folder shown in FIGS. 1A and 1B.

Referring to FIGS. 1A and 2, the folder 20 includes an unwind stand 28 on which the roll 24 is supported. The roll 24 has a roll axis 32 and consists of a web 34 of material wound around a core or shaft 38. The roll 24 is oriented on the unwinding stand 28 such that the web 34 is fed into downstream components of the folder 20 from the bottom of the roll 24. In other words, as viewed in FIGS. 1A and 2, the roll 24 rotates in a counter-clockwise direction when being unwound. In other embodiments, the web 34 is unwound from the top of the roll 24. The unwind stand 28 can take any form, and in some embodiments includes support legs 42 for supporting the shaft 38 on which the roll 24 is mounted. The roll 24 is rotated in any manner, such as by directly or indirectly driving the shaft 38 with a motor, by a drive belt 46 (see FIGS. 1A and 2) movable into contact with the roll 24 and drivable to rotate the roll 24 via frictional engagement of the drive belt 46 with the periphery of the roll 24, and the like. In the illustrated embodiment, the drive belt 46 is movable into and out of contact with the roll 24 by an actuating cylinder 50. The actuating cylinder 50 can take a number of different forms, such as for example a hydraulic or pneumatic cylinder. In other embodiments, the drive belt 46 is movable by rotating a shaft upon which the drive belt 46 is mounted, by a rack and pinion assembly connected to the drive belt 46, or in any other manner. In some embodiments, the cylinder 50 (or other element or mechanism used to drive the periphery of the roll 24) is reactive to the reduction of the roll diameter in order to maintain contact between the drive belt 46 and the roll 24. The folder 20 can also include a dancer roll 54 and/or one or more web guides 58 in order to control the speed of the web fed from the roll 24 and to properly guide the web fed from the roll 24, respectively. Dancer rolls 54 and web guides 58 are well known in the art and will not therefore be discussed further herein.

Figure 3:
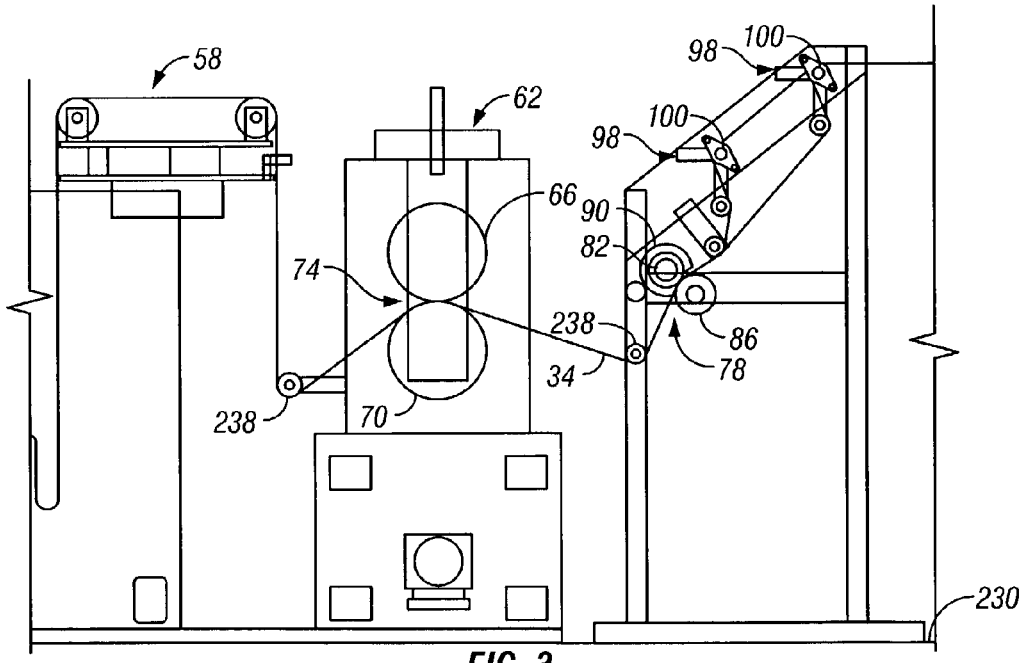
FIG. 3 is a view of the web guide, embosser, slitter, and synchronizer of the folder shown in FIGS. 1A and 1B.

Referring to FIGS. 1A and 3, the illustrated folder 20 further includes an embosser 62. Although not required to practice the present invention, the embosser 62 can be used to emboss a pattern into the web 34 as is often desired in napkins, paper hand towels, paper towels, and in many other products. The embosser 62 in the illustrated embodiment includes an upper roll 66 and a lower roll 70 that define an embosser nip 74 therebetween through which the web 34 passes. Other orientations of the rolls 66, 70 (e.g., side-by-side rolls 66, 70 between which the web 34 passes or rolls 66, 70 positioned in other manners) can instead be used as desired. The exterior of the upper and lower rolls 66, 70 can be made of a number of different materials such as rubber, metal, plastic, etc. In some embodiments, the upper and lower rolls 66, 70 can have separate elements mounted to the exterior thereof (e.g., one or more mats, screens, sleeves, and the like) and having a pattern thereon to emboss the web 34. As indicated above, the use of an embosser 62 in the folder 20 is optional, and is dependent at least in part upon the type of products being produced by the folder 20 and the types of web materials run in the folder 20. Accordingly, in some embodiments of the present invention, the folder 20 does not include an embosser 62.

With continued reference to FIGS. 1A and 2, the folder 20 can further include a slitter 78 that slits the web 34 into two or more narrower webs 34. The slitter 78 can take any conventional form, and in some embodiments includes a slitter roll 82 and a slitter anvil roll 86. The slitter roll 82 includes one or more slitting blades 90 that slit the passing web 34 and cooperate with (e.g., is received within) one or more slots in the slitter anvil roll 86 during slitting operations. In the illustrated embodiment, the web 34 is slit into two narrower webs that are separately directed downstream through the folder 20 for further processing. Alternatively, the slitter 78 can slit the web 34 into any number of narrower webs desired, such as by employing more slitting blades 90 on the slitter roll 82. In some embodiments of the present invention, the folder 20 does not include or does not utilize the slitter 78 and therefore, the web 34 is not slit. Slitters 78 are well known in the art and are not therefore discussed further herein.

In embodiments of the present invention that include an embosser 62, it is sometimes desirable to synchronize the pattern embossed in the web 34 with a cutting roll (discussed in greater detail below) downstream of the embosser 62. For example, it is sometimes desirable to have napkins with identical patterns and orientations of patterns thereon, in which case it is often desirable for the cutting roll to cut the napkins at the same location each time with respect to the pattern on the napkins. An exemplary mechanism for changing the web travel distance to the cutting roll in order to properly position the web 34 with respect to the cutting roll is illustrated in FIGS. 1A and 3. Specifically, the folder 20 of the present invention can have one or more synchronizing arms 98 for synchronizing the web 34 with the downstream cutting roll. The synchronizing arms 98 are movable (e.g., rotatable about respective pivots 100) to adjust the length of web 34 between the embosser 62 and the cutting roll, thereby synchronizing the embosser 62 and the cutting roll. In some embodiments of the present invention, synchronizing arms 62 are not utilized in the folder 20 because synchronization of the embosser 62 and the cutting roll is not necessary or desired, or because the folder 20 does not include an embosser 62. Synchronizing arms 62, assemblies, and other devices employed to control web length between points in a machine are well known to those skilled in the art and are not therefore described further herein.

Figure 4:
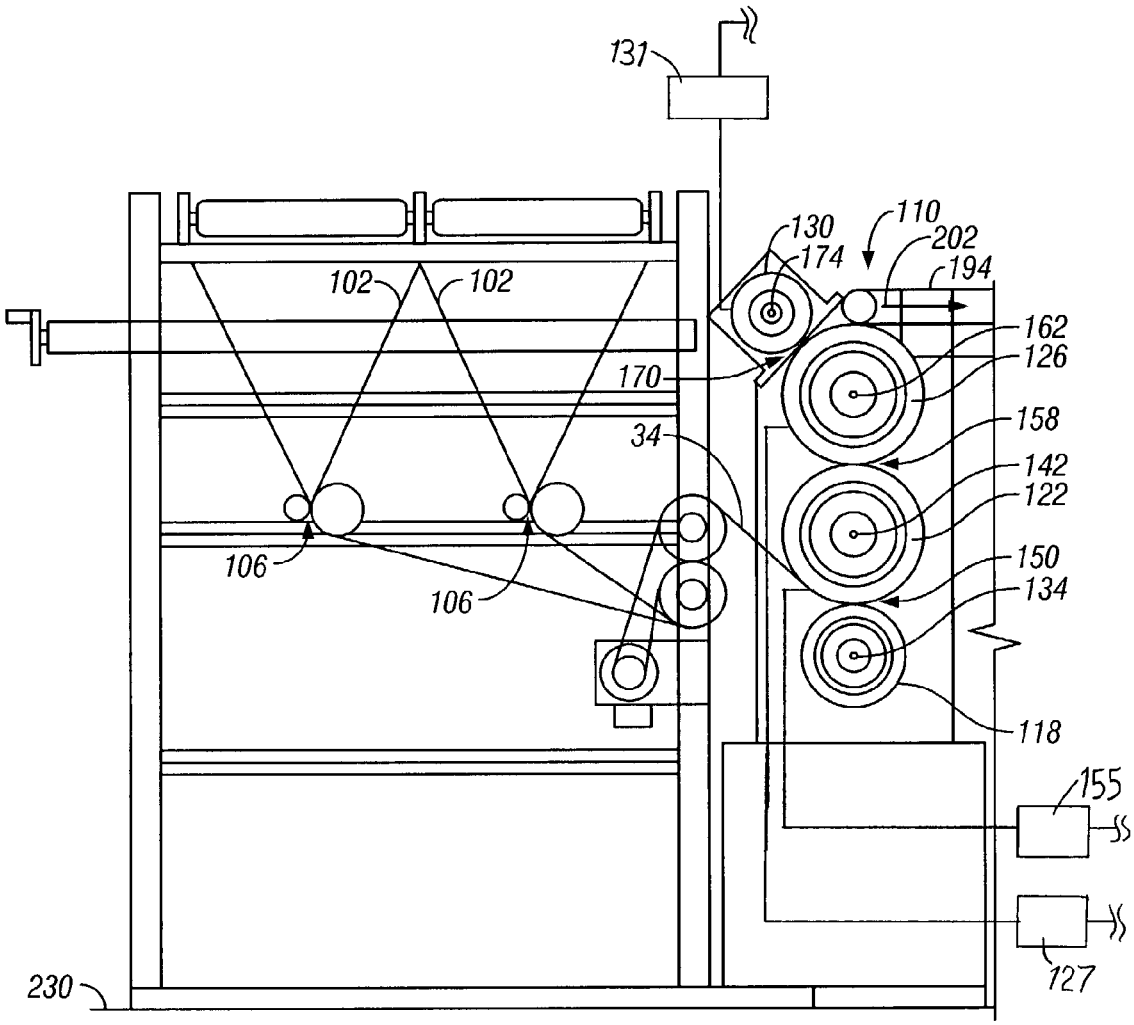
FIG. 4 is a view of the forming boards, creasers, folding assembly, and belt assembly of the folder shown in FIGS. 1A and 1B.

Referring to FIGS. 1A, 1B, and 4, the folder 20 also includes forming boards 102 and creasers 106. The folder 20 can have any number of forming boards 102 and creasers 106 desired, and in some embodiments has no forming boards 102 or creasers 106 at all (i.e., where longitudinal folding of the web(s) 34 using such devices is not desired). The folder can have as many forming boards 20 and creasers 106 as the number of webs 34 running therethrough. For example, two side-by-side webs 34 run to respective forming boards 30 and creasers 106 in the illustrated embodiment. In other cases, additional forming boards 30 and creasers 106 can be employed—a forming board 30 and creaser 106 for each web running from the slitter 78 or from other upstream equipment. In still other embodiments, the folder 20 has more forming boards 30 and creasers 106 than webs 34 run through the folder 20. For example, one or more of the webs 34 can be left unfolded and creased, or additional forming boards 30 can be available for running wider webs 34 from the roll 24. Forming boards 102 and creasers 106 are both well known in the art and are not therefore described further herein.

Figure 5:
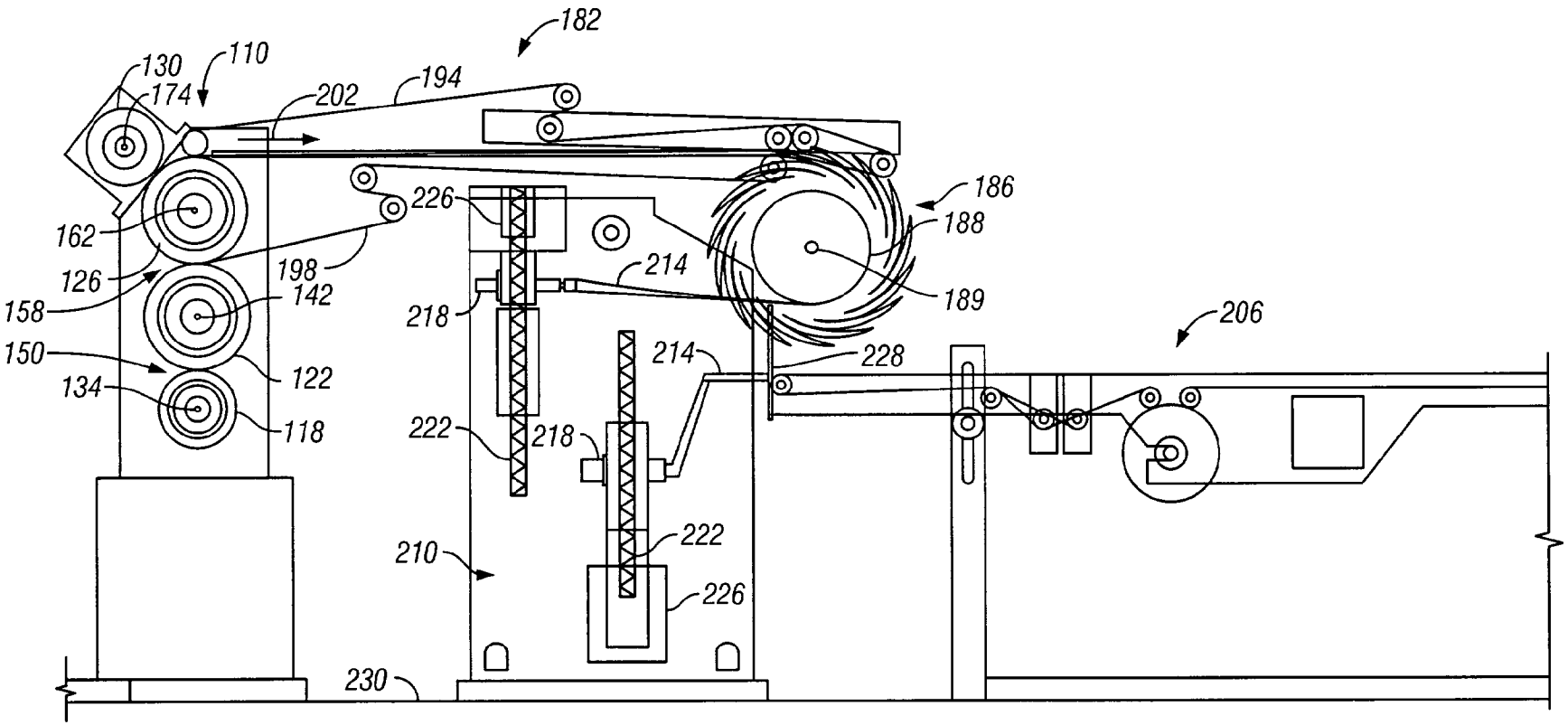
FIG. 5 is a view of the folding assembly, belt assembly, starwheel assembly, and conveyor system of the folder shown in FIGS. 1A and 1B.

Referring now to FIGS. 1B, 4, and 5, the folder 20 in the illustrated embodiment includes a folding assembly 110 for cutting the web 34 into sheets 114 and for folding the sheets 114. As will be discussed herein and illustrated in FIGS. 6–13, the folding assembly 110 of the illustrated embodiment can perform single transverse folds (e.g., quarterfolds) or both single transverse folds and double transverse folds (e.g., dispenser folds). The single and double transverse folds can be performed at any location on the sheets (e.g., the resulting folded product can be provided with a quarterfold or a dispenser fold as understood in the industry, and in some cases can be provided with one or more folds along any portion of the sheets). For this purpose, the folding assembly 110 includes a cutting roll 118, an anvil roll 122, a single transverse roll 126, and a double transverse roll 130.

The cutting roll 118 rotates about a cutting roll axis 134 and includes a cutting blade or other cutting element 138 for cutting the web 34 into sheets 114. In the illustrated embodiment, one cutting blade 138 is shown, in which case one sheet 114 is cut per revolution of the cutting roll 118. Sheet size can be adjusted by replacing the cutting roll 118 with another cutting roll 118 having a larger or smaller diameter (depending upon whether larger or smaller sheets, respectively, are desired), by including more or fewer blades on the cutting roll 118, by extending only a desired number of cutting blades 138 or other cutting elements on the cutting roll 118, or in still other manners. The cutting roll 118 can have any number of cutting blades 138. For example, the cutting roll 118 can have two cutting blades 138 disposed on opposite sides of the cutting roll 118 to cut two sheets 114 per single revolution of the cutting roll 118, the cutting roll 118 can have four cutting blades 138 disposed at quarter increments around the cutting roll 118 to cut four sheets 114 per single revolution of the cutting roll 118, and the like. Sheet size can be adjusted in these embodiments by either removing or adding cutting blades 138 to the cutting roll 118 or by adjusting the spacing between the cutting blades 138 (depending on whether larger or smaller sheets, respectively, are desired).

In the illustrated embodiment, the anvil roll 122 rotates about an anvil roll axis 142 and includes a slot 146 defined in the outer periphery thereof for receiving the cutting blade 138 or other cutting element therein. The anvil roll 122 can have any number of slots 146 for receiving the cutting blade 138. In the illustrated embodiment, the anvil roll 122 has two slots 146 therein, while the cutting roll 118 has one cutting blade 138. The anvil roll 122 and the cutting roll 118 are sized such that the anvil roll 122 rotates half of a revolution for every one revolution of the cutting roll 118. Therefore, the cutting blade 138 is received within a first of the slots 146 on the first revolution thereof, and is received within a second of the slots 146 on the second revolution thereof.

The anvil roll 122 can include an anvil blade 124 disposed against a side of each slot 146 (only one anvil blade 124 is illustrated in one of the slots 146 in the figures). By rotating the cutting roll 118, the cutting blade 138 contacts the anvil blade 124 to cut the web 34 into sheets 114. Accordingly, two sheets 114 are cut (discussed in greater detail below) for every revolution of the anvil role 122.

In some embodiments of the present invention, the anvil roll 122 includes the same number of slots 146 as cutting blades 138 or other cutting elements on the cutting roll 118. In such embodiments, the cutting and anvil rolls 118, 122 can have substantially the same diameter such that the anvil roll 122 rotates one revolution for every revolution of the cutting roll 118. In other embodiments of the present invention, the cutting blade 138 and the slots 146 are reversed on the anvil roll 122 and the cutting roll 118. In other words, the cutting blade 138 is positioned on the anvil roll 122 and the slots 146 are positioned on the cutting roll 118. In these embodiments, the cutting blade 138 and slots 146 operate in much the same manner as discussed above.

In further embodiments of the present invention, only one of the cutting roll 118 or the anvil roll 122 is utilized and includes either anvil or cutting blades thereon. In such embodiments, another element (which can be stationary), such as a bar, beam, or rod, is employed in place of either the cutting roll 118 or the anvil roll 122, and can have one or more blades against which the anvil or cutting roll blades cut the web 34.

One having ordinary skill in the art will appreciate that the web 34 can be cut by passing between two rotating rolls 118, 122 as shown in the figures (in which case cutting blades or other cutting elements or features can be located on either or both rolls 118, 120), by passing between a rotating roll 118, 122 and another element that cooperate to cut the web 34 therebetween (e.g., via blades or other cutting elements or features on either or both the rotating roll 118, 122 and the other element), or in still other manners. Accordingly, the term "blade" as used herein and in the appended claims refers to all such features and elements employed to shear, rupture, or otherwise separate the web 34, regardless of which the feature or element is stationary or moves during the cutting process and regardless of whether the element is a cutting blade or an anvil blade.

In still other embodiments of the present invention, only one of the anvil roll 122 or cutting roll 118 is employed to cut the web 34, and includes at least one cutting blade that cuts the web 34 thereupon, such as by extending from the roll 112, 118, cutting the web drawn against the surface of the roll 112, 118, or in other manners.

With continued reference to the exemplary folding assembly 110 in the illustrated embodiment, a cutting nip 150 is defined between the cutting roll 118 and the anvil roll 122 in the illustrated embodiment. The web(s) 34 pass through the cutting nip 150 and are cut therein into a plurality of sheets 114 by the cutting blade 138 as described above. In the illustrated embodiment, the anvil roll 122 includes anvil vacuum ports 154 arranged in lines (only the end vacuum ports 154 being visible in FIGS. 6–13) across the anvil roll 122 for selectively drawing a leading edge of the severed web 34 against the anvil roll 122. As will be discussed in greater detail below, the anvil vacuum ports 154 draw the webs 34 against the anvil roll 122 prior to being cut by the cutting blade 138, and maintain this retaining vacuum force upon the leading edges of the cut webs 34 after the webs 34 have been cut into sheets 114. The anvil roll 122 can have any number of vacuum port 154 or sets of vacuum ports 154. In those cases where sets of vacuum ports 154 are employed, the sets of vacuum ports 154 can be arranged on the anvil roll 122 in any manner desired, such as in lines running along the anvil roll 122 in manner (e.g., straight, curved, or otherwise), in regions on the anvil roll 122, and the like. In some embodiments of the present invention, the anvil roll 122 includes at least one anvil vacuum port 154 for selectively drawing a leading edge of the severed web 34 against the anvil roll 122.

The anvil vacuum ports 154 are connected to a vacuum supply (not shown) for selectively providing vacuum to the anvil vacuum ports 154. The anvil vacuum ports 154 can be connected to the vacuum supply by one or more vacuum valves 155 (see FIG. 4) coupled to the anvil roll 122. The vacuum valve 155 is operable to selectively supply vacuum to the anvil vacuum ports 154, thereby enabling vacuum force upon the web 34 to be applied and not applied as desired. In the illustrated embodiment, the anvil roll 122 has two lines of anvil vacuum ports 154, although any number of lines of anvil vacuum ports 154 can be provided in any location on the anvil roll 122. Each line of anvil vacuum ports 154 in the illustrated embodiment is located adjacent one of the slots 146 in the anvil roll 122. In some embodiments, one or more lines of anvil vacuum ports 154 are located adjacent to and behind each anvil blade 124 (with reference to the direction of rotation of the anvil roll 122) in order to hold the portion of the web 34 behind the blade 124 to the anvil roll 124 prior to, during, and/or after the web 34 is severed. In other embodiments of the present invention, one or more lines of anvil vacuum ports 154 are located adjacent and in front of each anvil blade 124 (with reference to the direction of rotation of the anvil roll 122). In still other embodiments of the present invention, one or more lines of vacuum ports 154 are located adjacent the anvil blade 124 and on both sides of each anvil blade 124.

The anvil roll 122 can have any number of anvil vacuum ports 154 adjacent any number of anvil blades 124 to hold leading edges of the severed web 34 or sheets 114 adjacent to the anvil blades 124. In addition to or instead of vacuum ports 154 located adjacent anvil blades 124 on the anvil roll 122, anvil vacuum ports 154 can be located anywhere on the surface of the anvil roll 122 to retain sheets 114 thereon. In some embodiments, the anvil vacuum port 154 selectively retains portions of sheets 114 other than the leading edges, such as trailing edges or any other portions of the sheets 114, to the anvil roll 122.

In some embodiments of the present invention, the anvil roll 122 also includes at least one anvil air port 156, such as a line of anvil air ports 156 disposed across the exterior of the anvil roll 122. The air ports 156 can blow a portion of the sheets 114 off of the anvil roll 122 at certain times throughout the folding process (discussed in greater detail below). In the illustrated embodiment, there are four lines of air ports 156 (only one air port of each line being visible in FIGS. 6–13) disposed around the anvil roll 122. Two lines of air ports are disposed behind each line of vacuum ports 154 (relative to the direction of rotation of the anvil roll). The anvil roll 122 can include any number of lines of air ports 156 and still be within the spirit and scope of the present invention. The lines of air ports 156 can also be positioned in any orientation with respect to one another. In addition, any number of air ports 156 arranged in lines, regions, or in other manners can be located in the anvil roll 122 for moving all or part of sheets 114 off the anvil roll 122.

The anvil and single transverse rolls 122, 126 in the illustrated embodiment define a single transverse nip 158 therebetween through which sheets 114 pass. The single transverse roll 126 rotates about a single transverse roll axis 162 and can include vacuum ports 166 connected to a vacuum supply (not shown) for selectively providing vacuum to the vacuum ports 166 on the single transverse roll. In some embodiments of the present invention, the single transverse vacuum ports 166 operate in a similar manner to the anvil vacuum ports 154. In the illustrated embodiment, the single transverse roll 126 includes two lines of single transverse vacuum ports 166 (only the end vacuum ports 166 are visible in FIGS. 6–13) extending across the exterior thereof for selectively retaining sheets 114 to the surface of the single transverse roll 126. One or more lines of ports 166 can be employed to selectively retain each sheet 114 on the single transverse roll 126. In some embodiments, the single transverse roll 126 includes multiple lines of vacuum ports 166 for retaining each sheet 114 to the single transverse roll 126. Any number of vacuum ports 166 can be located anywhere around the periphery of the single transverse roll 126 and can be in any arrangement desired, including those described above with regard to the vacuum ports 154 in the anvil roll 122.

Like the anvil roll 122, the single transverse roll 126 has at least one vacuum valve 127 (see FIG. 4) connected thereto. In particular, the vacuum ports 166 of the single transverse roll 126 can be connected to a vacuum supply (not shown) by one or more vacuum valves 127 coupled to the single transverse roll 126. The vacuum valve 127 is operable to selectively supply vacuum to the vacuum ports 166 of the single transverse roll 126, thereby enabling vacuum force upon sheets 114 to be applied and not applied as desired.

In some embodiments, the single transverse roll 126 also includes one or more air ports 168, such as a line of air ports 168 disposed across the exterior of the single transverse roll 126. The air ports 168 operate in a similar manner to the anvil air ports 156 described above, and blow a portion of the sheets 114 off of the single transverse roll 126 at desired times in the folding process (discussed in greater detail below). In the illustrated embodiment, there are four lines of air ports 168 (only four air ports are visible in FIGS. 6–13) disposed around the single transverse roll 126. Two lines of air ports 168 are disposed behind each line of vacuum ports 166 (relative to the direction of rotation of the single transverse roll 126). The single transverse roll 126 can include any number air ports 168 arranged in any manner desired on the single transverse roll 126, including the manners described above with reference to the air ports 156 on the anvil roll 122. In those embodiments employing air ports 168 arranged in lines, the lines of air ports 168 can also be positioned in any orientation with respect to one another.

In the illustrated embodiment, the cutting roll axis 134, the anvil roll axis 142, and the single transverse roll axis 162 are substantially vertically aligned with one another. In other embodiments, the cutting roll 118, anvil roll 122, and single transverse roll 126 can be arranged in any other manner still providing a nip between the cutting roll 118 and the anvil roll 122, and a nip between the anvil roll 122 and the single transverse roll 126. By way of example only, the axes 134, 142, 162 of the three rolls 118, 122, 126 can be substantially horizontally aligned with one another or can be arranged to define an L or V-shape.

The single and double transverse rolls 126, 130 in the illustrated embodiment define a nip 170 therebetween through which sheets 114 pass. The double transverse roll 130 rotates about a double transverse roll axis 174 and can include one or more vacuum ports 178 connected to a vacuum supply (not shown) for selectively providing vacuum to the vacuum ports 178 on the double transverse roll 130.

Like the anvil roll 122 and single transverse roll 126, the double transverse roll 130 has at least one vacuum valve 131 (see FIG. 4) connected thereto. In particular, the vacuum ports 178 of the double transverse roll 130 can be connected to a vacuum supply (not shown) by one or more vacuum valves 131 coupled to the double transverse roll 131. The vacuum valve 131 is operable to selectively supply vacuum to the vacuum ports 178 of the double transverse roll 130, thereby enabling vacuum force upon sheets 114 to be applied and not applied as desired.

In some embodiments of the present invention, the vacuum ports 178 on the double transverse roll 130 operate in a similar manner to the vacuum ports 154, 166 on the anvil and single transverse rolls 122, 126. In the illustrated embodiment, the double transverse roll 130 includes one line of vacuum ports 178 for selectively retaining a sheet 114 to the surface of the double transverse roll 130, although additional lines of vacuum ports 178 can be employed on the double transverse roll 130 for this purpose as desired. In some embodiments, the double transverse roll 130 includes multiple lines of vacuum ports 178 for retaining sheets 114 thereon. The vacuum ports 178 can be located in any arrangement anywhere around the periphery of the double transverse roll 130, including those mentioned above with reference to the vacuum ports 154 on the anvil roll 122.

In some embodiments, the double transverse roll 130 also includes at least one air port 180, such as one or more lines of double transverse air ports 180 disposed across the exterior of the double transverse roll 130. The air ports 180 can be arranged in any manner on the double transverse roll 130, including those described above with regard to the air ports 156, 168 of the anvil and single transverse rolls 122, 126. The air ports 180 can operate in a similar manner to the anvil and single transverse air ports 156, 168 to blow at least a portion of the sheets 114 off of the double transverse roll 130 at desired times in the folding process (discussed in greater detail below). In the illustrated embodiment, there are two lines of air ports 180 (only two air ports of which are visible in FIGS. 6–13) disposed around the double transverse roll 130. The two lines of air ports 180 are disposed behind the line of vacuum ports 178 relative to the direction of rotation of the double transverse roll 130. In those embodiments in which lines of air ports 180 are employed, the double transverse roll 130 can include any number of lines of air ports 180. The lines of air ports 180 can also be positioned in any orientation with respect to one another.

In the illustrated embodiment, the double transverse roll 130 is positioned above and to a side of the single transverse roll 126. However, the double transverse roll 130 can be located in any position relative to the single transverse roll 122 while still defining a nip 170 therebetween. For example, the double transverse roll 130 can be positioned on either side of the single transverse roll 126. In other embodiments, the double transverse roll 130 can be positioned above the single transverse roll 126 such that the double transverse roll axis 174 is positioned substantially directly above the single transverse roll axis 162. In other embodiments, the double transverse roll 130 can be positioned beside the single transverse roll 126 such that the double transverse roll axis 174 is substantially horizontally aligned with the single transverse roll axis 162. In still other embodiments, the double transverse roll 130 is located at any other circumferential position of the single transverse roll 126.

The double transverse roll 130 in the illustrated embodiment can be employed to generate a fold in a sheet 114 passing through the nip 170 between the single and double transverse rolls 126, 130 as will be described in greater detail below. However, if such a fold is not desired, the double transverse roll 130 can be deactivated (i.e., vacuum shut off to the double transverse roll 130) so that the sheet 114 will pass through the nip 170 between the single and double transverse rolls 126, 130 without being folded thereby. In some embodiments of the present invention, the double transverse roll 130 is movable toward and away from the single transverse roll 126 when the double transverse roll 130 is activated and deactivated, respectively. By way of example only the double transverse roll 130 can be mounted to one or more arms that are rotatable and/or translatable to move the double transverse roll 130 with respect to the single transverse roll 126. As another example, either or both ends of the double transverse roll 130 can be mounted within a track or tracks to enable movement of the double transverse roll 130 with respect to the single transverse roll 126. In other embodiments of the present invention, the double transverse roll 130 remains in the same position with respect to the single transverse roll 126 in both the activated and deactivated states of the double transverse roll 130. In some embodiments, the double transverse roll 130 rotates when activated and does not rotate when deactivated, in which case sufficient clearance exists between the single and double transverse rolls 126, 130 to permit sheets 114 to pass therebetween. In other embodiments, the double transverse roll 130 is not driven but can still rotate when deactivated (e.g., wherein the double transverse roll 130 is driven through a conventional clutch mechanism). In still other embodiments, the double transverse roll 130 is driven to rotate regardless of whether vacuum is supplied thereto.

With further reference to FIGS. 1B, 4, and 5, the illustrated embodiment of the folder 20 also includes a belt assembly 182 and a stacking or starwheel assembly 186. The belt assembly 182 transports sheets 114 from the double transverse nip 170 to at least one starwheel 188 in preparation of stacking the folded sheets 114. The belt assembly 182 can have any number of belts, such as a single belt extending to the starwheel assembly 186 and upon which folded sheets 114 are conveyed, or upper and lower belts 194, 198 traveling along respective paths at substantially similar speeds and between which folded sheets 114 are conveyed as shown in FIGS. 1B, 4, and 5. In the illustrated embodiment in which upper and lower belts 194, 198 are employed, the upper belt 194 travels in a counter-clockwise direction and the lower belt 198 travels in a clockwise direction as viewed in FIGS. 1B, 4, and 5. The two belts 194, 198 have portions thereof that face one another (and in some embodiments are in contact with one another) to define a transport path, indicated by arrow 202, directed toward the star wheel 186. Whether the sheets 114 conveyed by the belt assembly 182 have a single transverse fold or a double transverse fold, the sheets 114 are captured between the belts 194, 198 and transported toward the starwheel assembly 186.

In some embodiments, other types of conveyor systems or conveying devices can instead be employed to move the folded sheets 114 from the folding assembly 110 to the stacking assembly 186, such as a single continuous conveyor belt upon which folded sheets 114 ride (and having at least a portion thereof extending from the folding assembly 110 to the stacking assembly 186), a translatable and/or rotatable arm or arms having clamps disposed thereon for clamping the folded sheets 114 at the folding assembly 110 and placing the folded sheets 114 in the stacking assembly 186, a paddle, bucket, chain, or tabletop conveyor, and the like. In other embodiments, the path 202 is not necessarily horizontal (as illustrated in FIGS. 1B, 4, 5, and 6–13). Specifically, the path 202 can be oriented in any direction or combination of directions to transfer the folded sheets 114 from the folding assembly 110 to the stacking assembly 186 at any angle.

In those embodiments employing starwheels to stack the folded sheets 114 (such as that shown in the figures), the stacking assembly 186 can include a plurality of starwheels 188 that rotate about a starwheel axis 189. Such starwheel assemblies can have any number of starwheels 188. In some embodiments of the present invention, other types of stacking assemblies known to those skilled in the art can be utilized with the folder 20.

The folded sheets 114 are fed into the starwheels 188 of the starwheel assembly 186 by the belts 194, 198 at the end of the transport path 202. In other embodiments, any one or more of the other rolls 118, 122, 130 of the folding assembly are driven by a motor or other conventional driving device, and drive the belt assembly 182. Alternatively, the single transverse roll 126 can be driven by a motor or other conventional driving device, and can drive the belt assembly 182 as best shown in FIGS. 1B, 4, and 5. In still other embodiments, either or both belts 194, 198 are driven by a motor or other conventional driving device, and drive the single transverse roll 126 and/or one or more of the other rolls in the folding assembly 110. The transmission of driving force between one or more of the rolls 118, 122, 126, 130 and the belts 194, 198 of the belt assembly 182 can be accomplished in a number of different manners, such as by one or more belts, chains, gears, and other power transmission elements and assemblies. In other embodiments of the present invention, the belt assembly 182 is independently driven. Starwheel assemblies and their manner of operation are well known in the art and therefore will not be discussed further herein.

After the folded sheets 114 have been fed into the starwheel assembly 186, the starwheels 188 of the starwheel assembly 186 rotate and place the sheets 114 onto a conveyor system 206 or onto a platform, elevator, bucket, or other conveying device as is well known to those skilled in the art. The illustrated embodiment of the folder 20 also includes a separator assembly 210 to assist the starwheel assembly 186 in placing the folded sheets 114 onto the conveyor system 206. In particular, the separator assembly 210 in the illustrated embodiment includes two sets of spaced-apart fingers 214 (only the end finger of each set being visible in FIGS. 1B and 5), an actuator 218 connected to each set of fingers 214 for driving the fingers 214 into and out of the stream of folded sheets 114 issuing from the starwheels 188, at least one screw-type actuator 222 connected to each actuator 218 for moving the actuators 218 and the fingers 214 to different vertical positions, and a motor 226 or other conventional driving device coupled to each screw-type actuator 222 to drive the screw-type actuators 222 in different directions. Each set of spaced-apart fingers 214 are substantially positioned in a common plane. Rotating the screw-type actuators 222 in one direction raises the actuators 218 and fingers 214, while rotating the screw-type actuators 222 in an opposite direction lowers the actuators 218 and fingers 214. It will be appreciated by one having ordinary skill in the art that the fingers 214 of the separator assembly 210 can be driven into and out of the stream of folded sheets 114 by any number of different actuators, including without limitation hydraulic or pneumatic cylinders, rack and pinion assemblies, solenoids, magnetic rails, and the like, any of which can be employed in the present invention. Similarly, the fingers 214 and actuators 218 can be driven to different vertical positions in a number of other manners, including without limitation any of the manners just described for actuating the fingers 214 into and out of the stream of folded sheets 114.

Although two sets of fingers 214 are illustrated in the figures and described above, any number of finger sets 214 can be employed to stack the sheets 114 (e.g., even a single set of fingers 214, such as in cases where at least part of the stack building process of each sheet can be performed upon a conveyor or other surface below the starwheel assembly 186, thereby permitting the single set of fingers 214 to be withdrawn for later re-insertion). Corresponding actuators 218, 222 and a corresponding motor 226 or other conventional driving device can be employed to move each such set of fingers 214.

With continued reference to the illustrated embodiment of the present invention, after the starwheel assembly 186 has stacked a desired amount of sheets 114 on the conveyor system 206 or other stacking location, a first set of fingers 214 can be moved beneath the starwheels 188 via a first actuator 218 to a position above the stacked sheets 114. Sheets 114 can then be stacked upon the first set of fingers 214 positioned beneath the starwheels 188 while the conveyor system 206 advances the stack of sheets 114 thereon out from beneath the starwheels 188. After the sheets 114 have been moved from beneath the starwheels 188, the conveyor system 206 can be stopped. A first screw-type actuator 222 corresponding to the first set of fingers 214 positioned underneath the starwheel 188 can be rotated via a first motor 226 corresponding to the respective first actuator 222 to lower the first actuator 218 and first set of fingers 214 to the level of the conveyor system 206. The first actuator 218 can then move the first set of fingers 214 out from beneath the sheets 114 stacked thereon to leave the sheets 114 on the conveyor system 206 in a position beneath the starwheels 188. A barrier 228 prevents the stacked sheets 114 from moving in the direction of the fingers 214 when the fingers 214 are moved out from beneath the starwheels 188. In some embodiments, the barrier 228 includes a plurality of slots (not shown) through which the fingers 214 can be inserted and withdrawn. The first motor 122 then rotates the first screw-type actuator 222 in a direction that raises and returns the first actuator 218 and the first set of fingers 214 to a position in which the first set of fingers 214 can be moved back into the stream of sheets in or issuing from the starwheels 188. The starwheels 188 continue to stack sheets 114 upon the sheets 114 already positioned beneath the starwheels 186.

When the sheets 114 are stacked to the desired level or number, a second set of fingers 214 can move into the stream of folded sheets 114 in or issuing from the starwheels 188 to separate the folded sheets 114. A second actuator 218, second screw-type actuator 222, and a second motor 226 can be connected to the second set of fingers 214, all of which operate in a similar manner to the first set of fingers 214, first actuator 218, first screw-type actuator 222, and the first motor 226, respectively. In some embodiments, the folded sheets 114 can be stacked upon the first set of fingers 214 until the second set of fingers 214 are inserted as described above, in which case the first set of fingers 214 can drop or otherwise transfer the completed stack thereon to the conveyor system 206. In those embodiments of the present invention employing two or more sets of fingers 214 for stacking the folded sheets, the sets of fingers (and their associated driving devices) can alternate to separate alternating stacks of folded sheets 114. This process can be repeated for each stack of sheets 114 produced by the starwheel assembly 186.

The starwheel assembly 186 other stacking assembly 186 can be arranged to discharge the folded sheets 114 laterally onto the conveyor 206 (i.e., with each sheet oriented vertically) or vertically (i.e., with each sheet oriented horizontally). Alternatively, the starwheel assembly or other stacking assembly can stack the folded sheets 114 in any other orientation between horizontal and vertical orientations.

In the illustrated embodiment, the folder 20 is supported on a ground surface 230. As used herein and in the appended claims, the term "ground surface" means any natural or man-made surface upon which the folder 20 can be supported, such as for example the ground, a floor of a building, a frame on which the folder 20 can be mounted, and the like.

Having this described the folder 20, operation of the exemplary folder 20 illustrated in the figures will now be described with respect to converting a roll 24 of material into folded sheets 114 of material. Referring to FIGS. 1A, 2, 3, and 4, a roll 24 of material is positioned and supported on the unwinding stand 28. Web 34 from the roll 24 is fed from the bottom of the roll 24 into the downstream components of the folder 20. The web 34 passes around the dancer roll 54 and one or more tensioning rollers 234 to provide the web 34 with sufficient tension within the folder 20. The web 34 then passes through a conventional web guide 58 to adjust the lateral position of the web 34 with respect to the folder 20. After passing beneath a guide roller 238, the web 34 passes through the embosser 62 and then beneath another guide roller 238. The web 34 then passes through the slitter 78 where the web 34 is slit (if desired) into a plurality of slit webs 34. Each of the slit webs 34 can then be passed beneath another guide roller 238, through one or more synchronizing arms 98 and through a forming board 102 and creaser 106. After exiting the creasers 106, the slit webs 34 can be passed through a plurality of guiding rollers 238 and into the folding assembly 110.

With reference to FIGS. 6–13, the operation of the folding assembly 110 and the folder 20 is described below with reference to one of the webs 34 (the only one visible in FIGS. 6–13). The second web 34 in FIGS. 6–13 is located behind the illustrated web 34 and follows a similar path through the folding assembly 110. Accordingly, the operation of the folding assembly 110 and folder 20 with respect to the other slit webs 34 entering the folding assembly 110 is substantially the same as that described below.

The folding assembly 110 of the illustrated embodiment can perform two types of folds: a single transverse fold and a single and double transverse fold. In the illustrated embodiment, the cutting roll 118, anvil roll 122, and single transverse roll 126 continuously rotate without interruption when the folder 20 is performing a single transverse fold. The double transverse roll 130 does not rotate when the folder 20 is performing a single transverse fold. In the illustrated embodiment, the cutting roll 118, anvil roll 122, single transverse roll 126, and double transverse roll 130 continuously rotate without interruption when the folder 20 is performing single and double transverse folds. In some embodiments of the present invention, the cutting roll 118, anvil roll 122, single transverse roll 126, and double transverse roll 130 continuously rotate whether the folder 20 is performing a single transverse fold or a single and double transverse fold.

Figure 6:
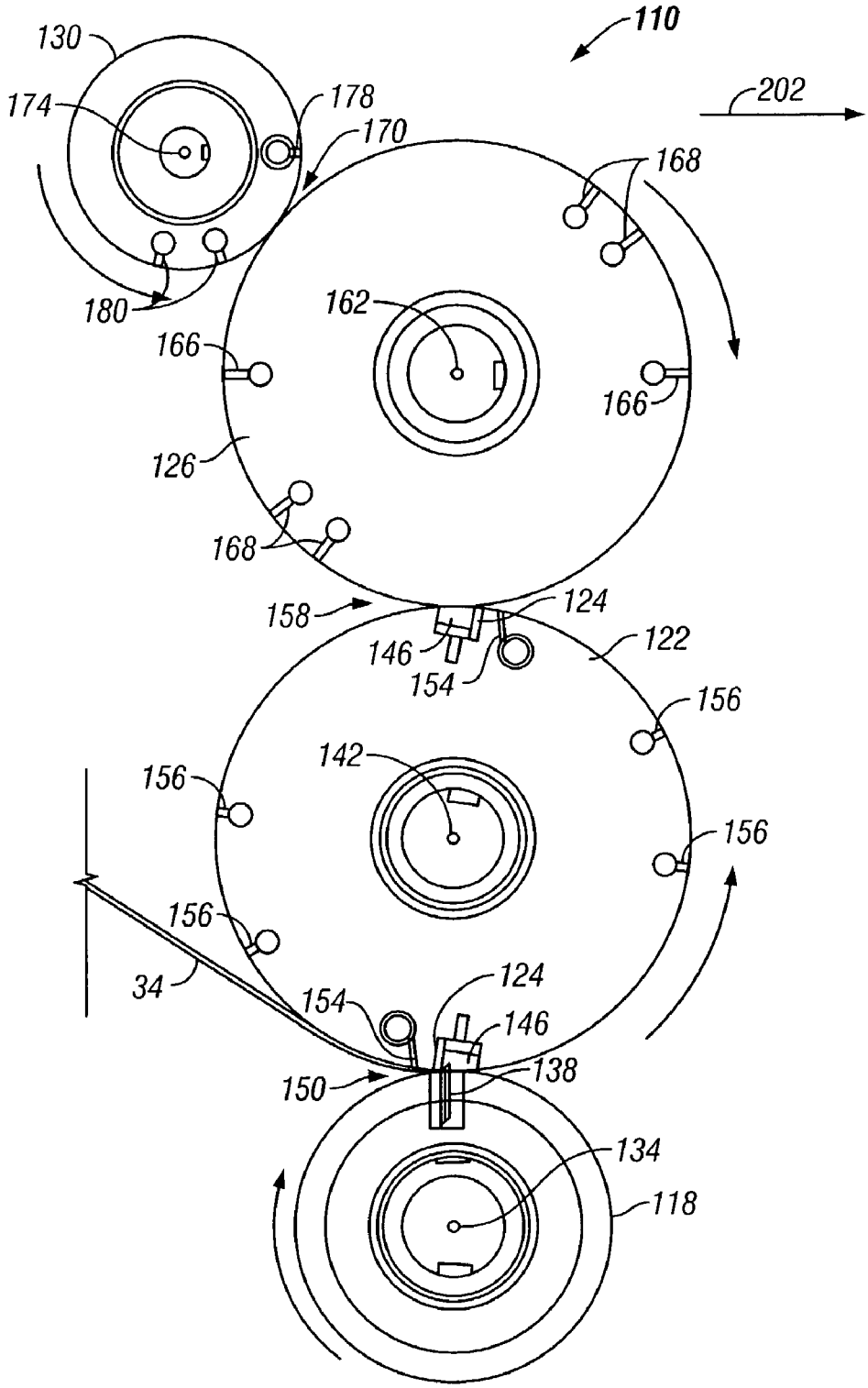
FIGS. 6–13 are schematic views of the folding assembly shown in FIGS. 1A, 1B, 4, and 5, shown in various folding operation stages of folding operations.
Figure 7:
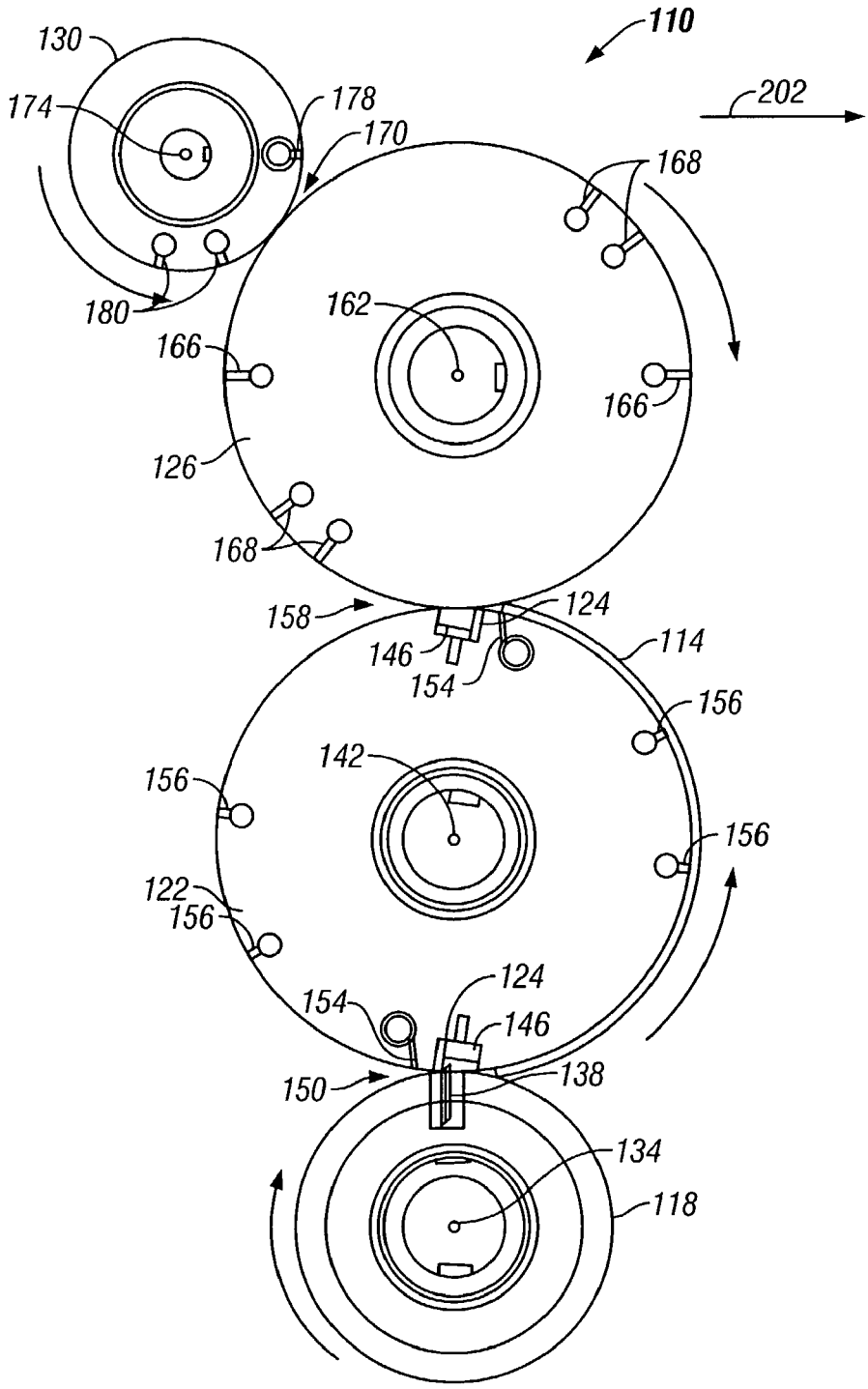

In FIG. 6, the web 34 passes into the cutting nip 150, where the web 34 is separated into leading and trailing edges. The leading edge is drawn against the anvil roll 122 by vacuum exerted through the anvil vacuum ports 154 (only one of which is visible in FIGS. 6–13). In FIG. 7, the cutting roll 118 rotates clockwise one revolution while the anvil roll 122 rotates half of one revolution in a counterclockwise direction with the web 34 retained against the anvil roll 122 by the vacuum force through the anvil vacuum ports 154. The rotation of the cutting and anvil rolls 118, 122 bring the web 34 into contact with the second anvil vacuum port 154, which also draws the web 34 to the anvil roll 122. The rotation of the cutting and anvil rolls 118, 122 also rotates the cutting blade 138 and the anvil blade 124 of their respective rolls 118, 122 into alignment with each other to cut a sheet 114 from the web 34. The leading edge of the sheet 114 remains in a position retained upon the surface of the anvil roll 122 by one of the lines of anvil vacuum ports 154 (the top vacuum port 154 as illustrated in FIG. 7), while the leading edge of the following portion of web 34 cut by the cutting blade 138 at the bottom of the anvil roll 122 in FIG. 7 is held against the anvil roll 122 by the other line of anvil vacuum ports 154 (the bottom anvil vacuum port as illustrated in FIG. 7).

Figure 8:
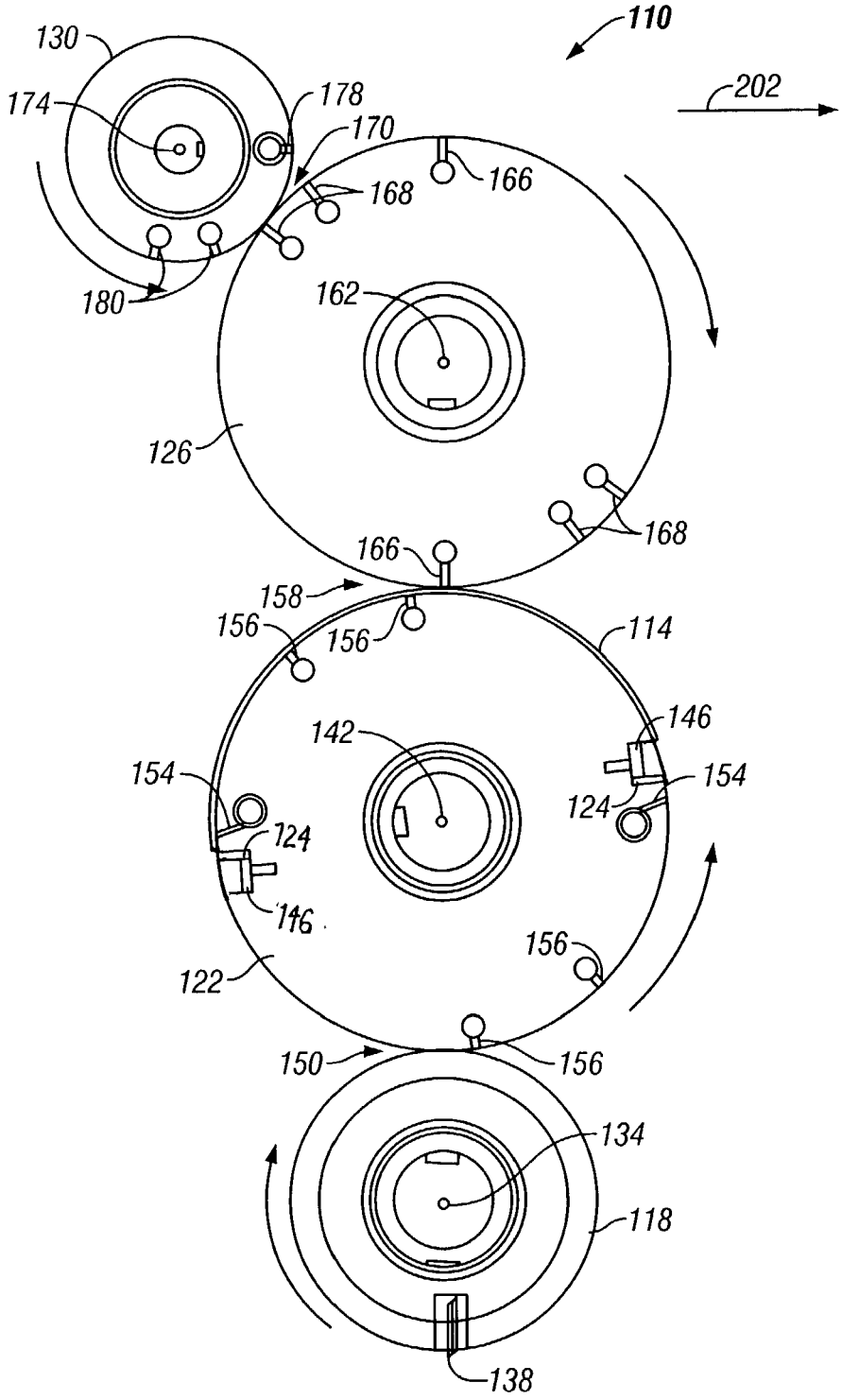

In FIG. 8, the rolls 118, 122, 126, 130 continue to rotate. More particularly, the anvil roll 122 rotates in a counterclockwise direction with the sheet 114 held thereagainst by the anvil vacuum ports 154 as described above, while the single transverse roll 126 rotates in a clockwise direction. In the illustrated embodiment, a vacuum port 166 of the single transverse roll 126 is located substantially at the middle of the sheet 114. The position of this vacuum port 166 with respect to the sheet 114 determines where the sheet 114 will be provided with a first or single transverse fold. Therefore, the sheet 114 in the illustrated embodiment will be provided with a first fold near the middle of the sheet 114. However, it should be noted that the vacuum port 166 adjacent to the sheet 114 as just described can instead be positioned anywhere else along the length of the sheet 114 in order to provide a first fold thereto while still being within the spirit and scope of the present invention. For example, the vacuum port 166 of the single transverse roll 126 can be positioned near one of the ends of the sheet 114 in order to provide a single transverse fold offset from the middle of the sheet 114. The location of folds produced by the anvil roll 122 and single transverse roll 126 can be changed in a number of different manners. By way of example only, vacuum can be exerted through a different vacuum port 166 on the single transverse roll 126 such that when the different vacuum port 166 is rotated to a position adjacent to the sheet 114 on the anvil roll 122, the different vacuum port 166 is located at a different position of the sheet 114. As another example, the single transverse roll 126 can be rotated with respect to the anvil roll 122 (or vice versa) to change the orientation of the single transverse roll 126 with respect to the anvil roll 122. Still other manners of adjusting the location of a fold produced by the anvil and single transverse rolls 122, 126 are possible.

When the anvil and single transverse rolls 122, 126 are in the position illustrated in FIG. 8, vacuum through the anvil vacuum ports 154 is shut off and vacuum through the vacuum port 166 on the single transverse roll 126 is generated. Accordingly, the sheet 114 is no longer retained upon the anvil roll 122, but is drawn by vacuum through the vacuum port 166 in the single transverse roll 126. In embodiments where multiple lines of vacuum ports are used to retain the sheet 114 to the anvil roll, vacuum can be shut off to all such lines, or at least those needed to release the sheet 114 from the anvil roll 122. Vacuum can be selectively ported to the various vacuum ports on the anvil, single transverse, and double transverse rolls 122, 126, 130 in a number of conventional manners, such as by one or more vacuum valves as described above (e.g., vacuum valves 155, 127, 131 at the end of each roll 122, 126, 130), a valve assembly located within each roll 122, 126, 130, and in any other conventional manner. Vacuum valves and other assemblies and methods for controlling and selectively porting vacuum to different desired locations on a roll and/or at different times during the rotation of a roll are well known to those skilled in the art and are not therefore described further herein.

Figure 9:
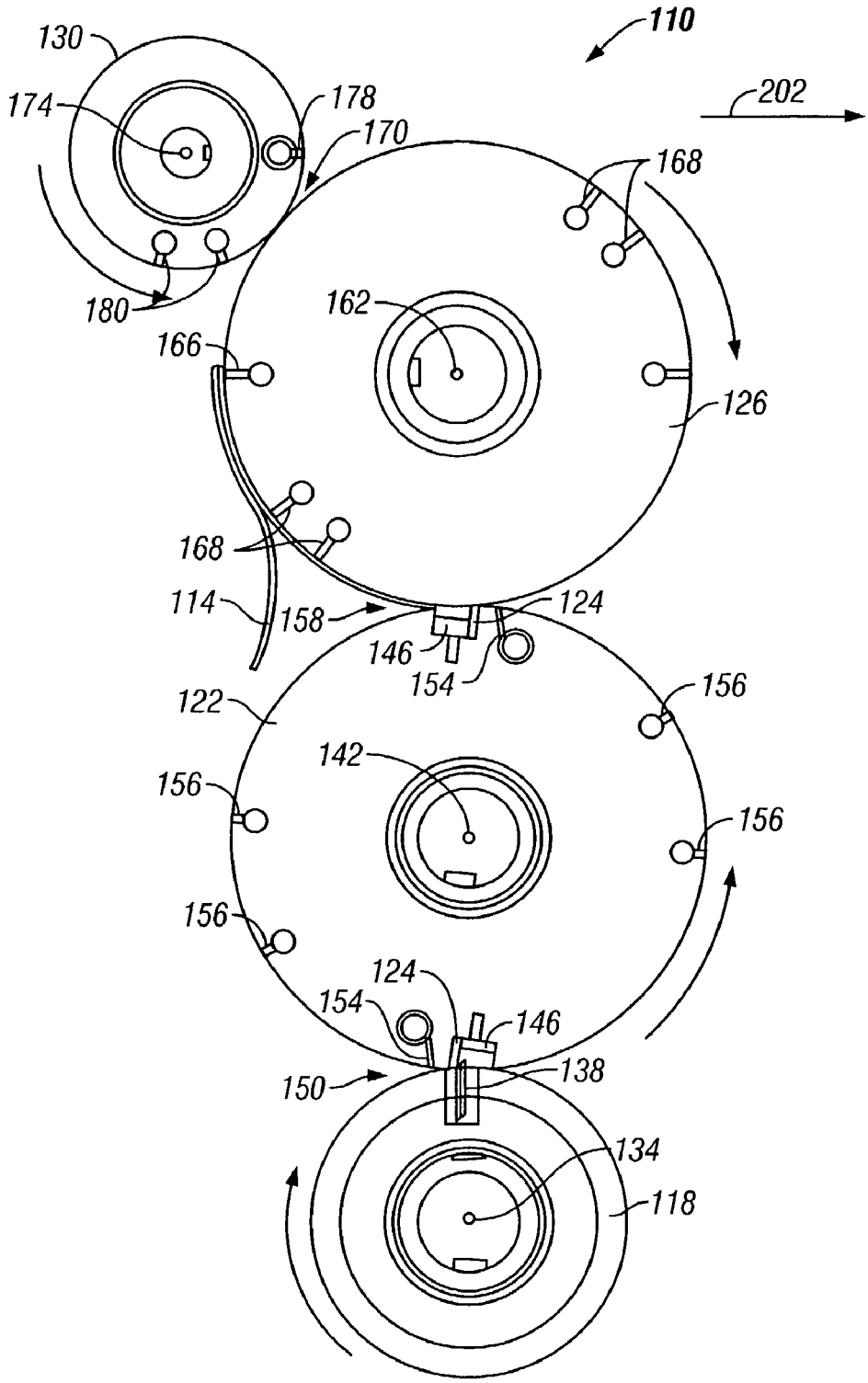

The rolls 118, 122, 126, 130 continue to rotate to the position illustrated in FIG. 9. The sheet 114 continues to be retained upon the surface of the single transverse roll 126, thereby pulling the sheet 114 from the anvil roll 122 as the anvil and single transverse rolls 122, 126 continue to rotate. As shown in FIG. 9, this rotational movement generates a single transverse fold in the sheet 114. In some embodiments of the present invention, a creasing bar, roller, or other element (not shown) adjacent to the single transverse roll 126 can be included to assist in folding the sheet 114. For example, a creasing bar can be disposed between the anvil and single transverse rolls 122, 126 and to a side of the nip 158 between these rolls 122, 126 so that the loose end of the sheet 114 pulled from the anvil roll 122 is drawn toward the single transverse roll 126.

Figure 10:
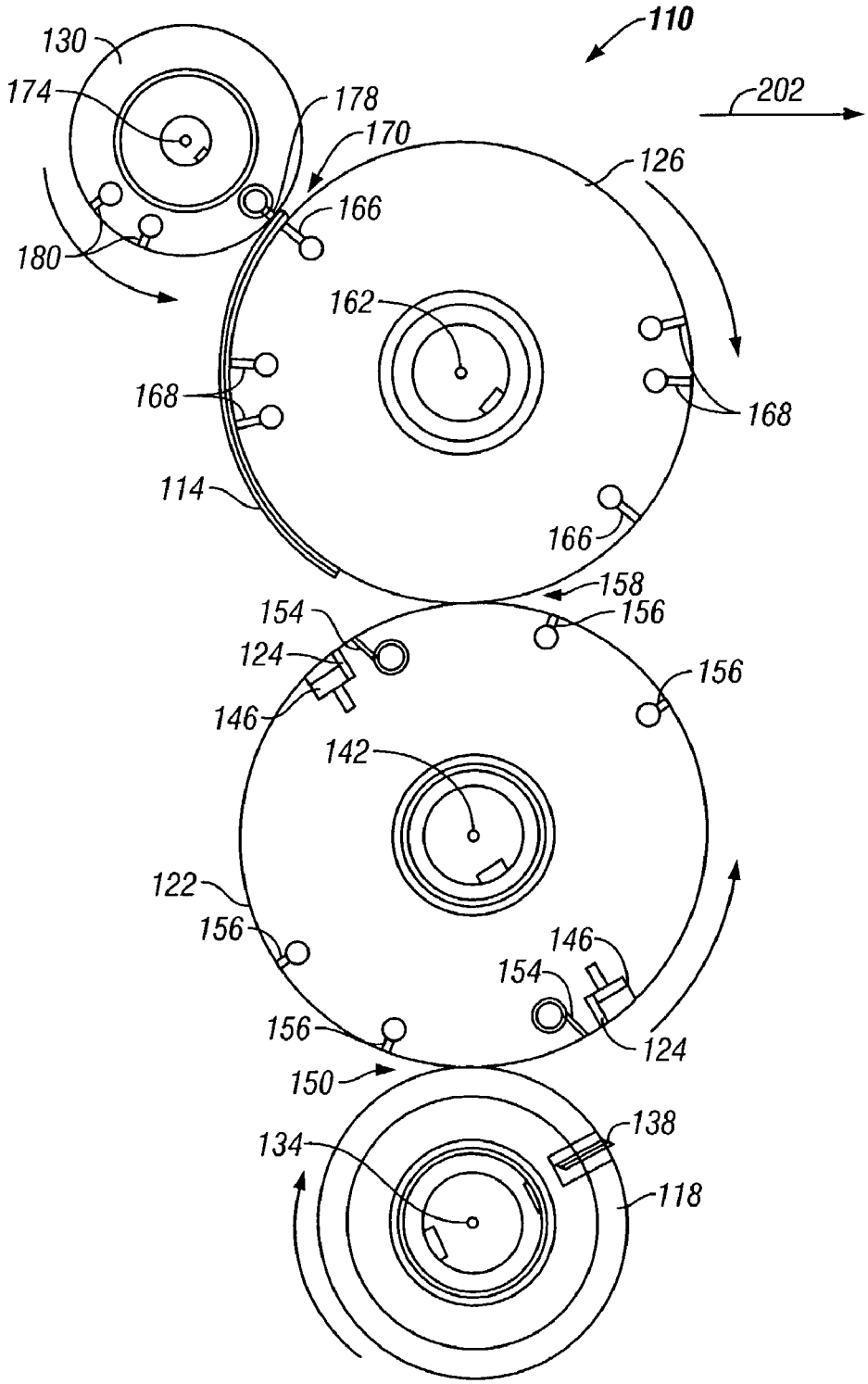

The rolls 118, 122, 126, 130 in the illustrated exemplary embodiment continue to rotate to the position illustrated in FIG. 10, where the vacuum ports 166, 178 in the single and double transverse rolls 126, 130 are adjacent or nearest to one another with the sheet 114 disposed therebetween. As mentioned above, the folder 20 can generate sheets 114 with either single transverse folds or single and double transverse folds. In cases where only a single transverse fold is desired, the double transverse vacuum port 178 remains closed to vacuum while vacuum continues to be supplied to the vacuum port 166 holding the folded sheet 114 to the single transverse roll 126. Therefore, the rolls 118, 122, 126, 130 continue to rotate to the position illustrated in FIG. 11*a*. At this position, the sheet 114 is approaching the belts 194, 198 that will convey the sheet 114 away from the folding assembly 110 as described above and shown in FIG. 12*a* (only one of the belts 198 being shown in FIGS. 11*a* and 12*a*).

Figure 11A:
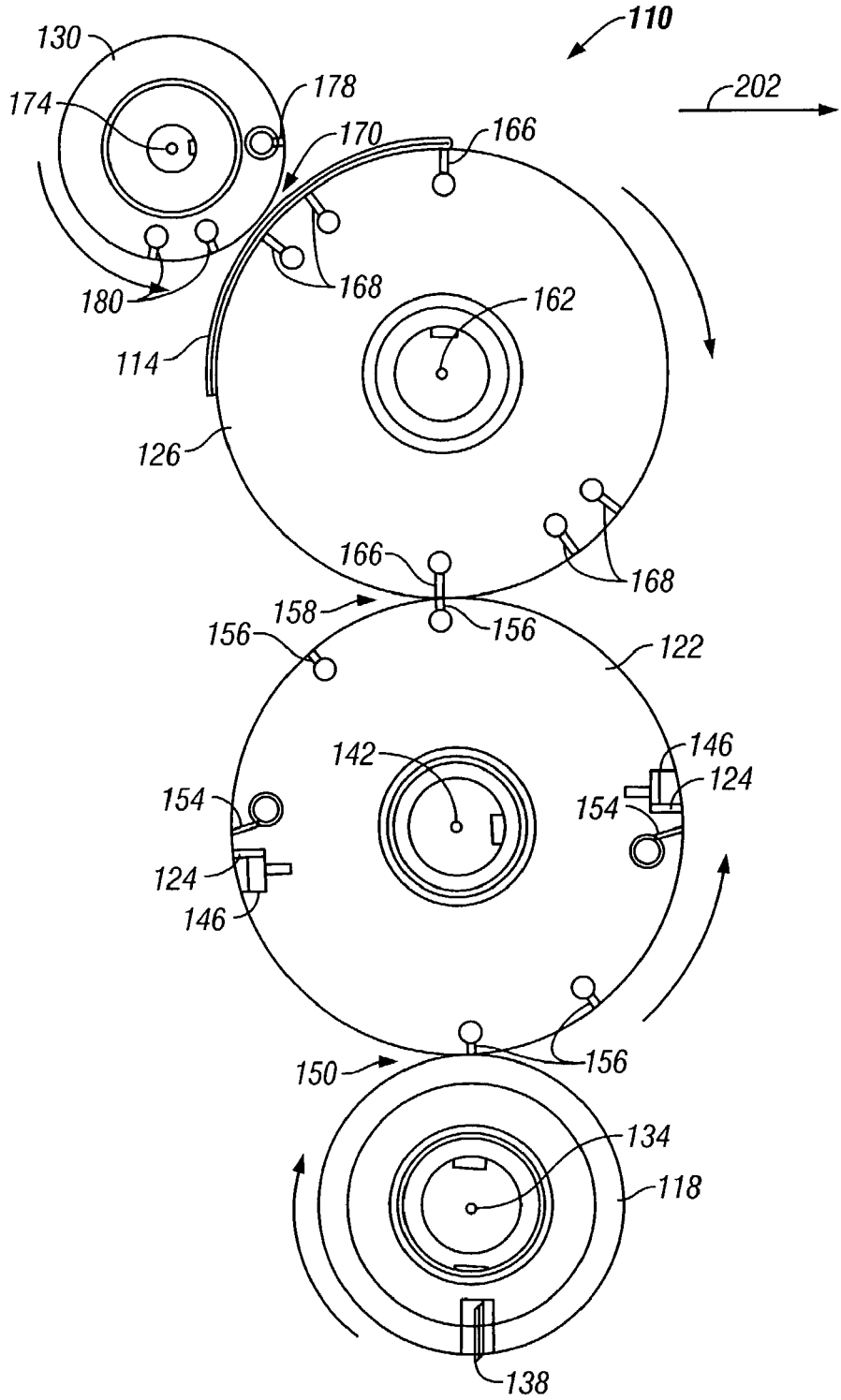
Figure 11B:
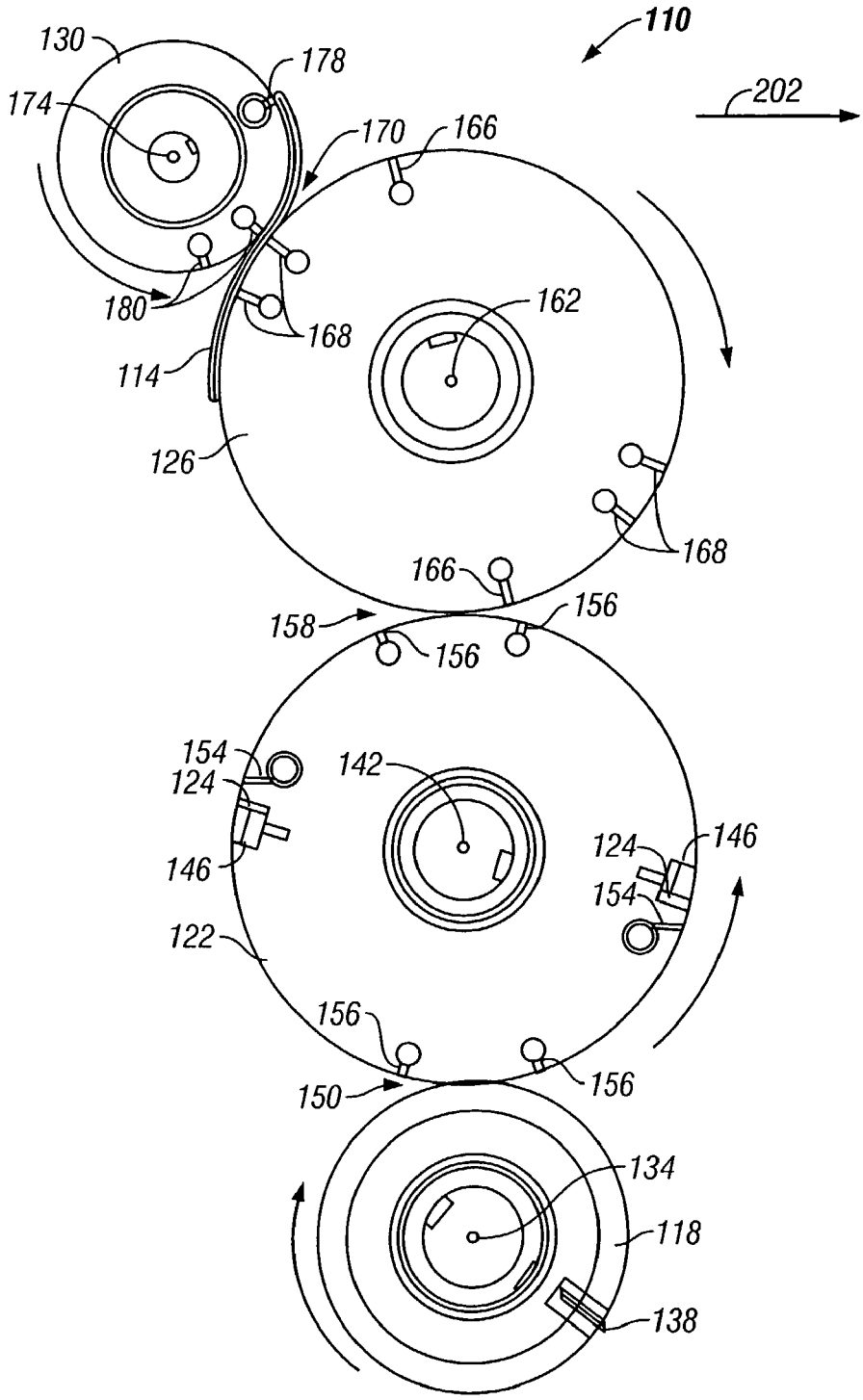

Referring to FIGS. 10, 11*b*, 12*b*, and 13, the operation of the rolls 118, 122, 126, 130 for producing double-transverse folded sheets 114 is similar in many respects to the operation of the rolls 118, 122, 126, 130 for producing single-transverse folded sheets 114. In particular, the procedure for producing double-transverse folded sheets 114 includes the same operations described above with reference to FIGS. 6–9. However, at the stage of operation shown in FIG. 10, vacuum is exerted through the double transverse vacuum port 178 of the double transverse roll 130 when the vacuum ports 166, 178 are aligned or are at least sufficiently close to one another to be able to transfer the folded sheet 114 from the single transverse roll 126 to the double transverse roll 130. In particular, vacuum is supplied through a vacuum port 178 of the double transverse roll 130 while vacuum is closed to the vacuum port 166 of the single transverse roll 126 retaining the folded sheet 114 upon the single transverse roll 126. Accordingly, the folded sheet 114 is drawn against the double transverse roll 130 rather than the single transverse roll 126 (as discussed above with regard to the production of single transverse folds). With reference next to FIG. 11*b*, the double transverse roll 130 then continues to rotate with the folded sheet retained thereagainst.

Figure 12A:
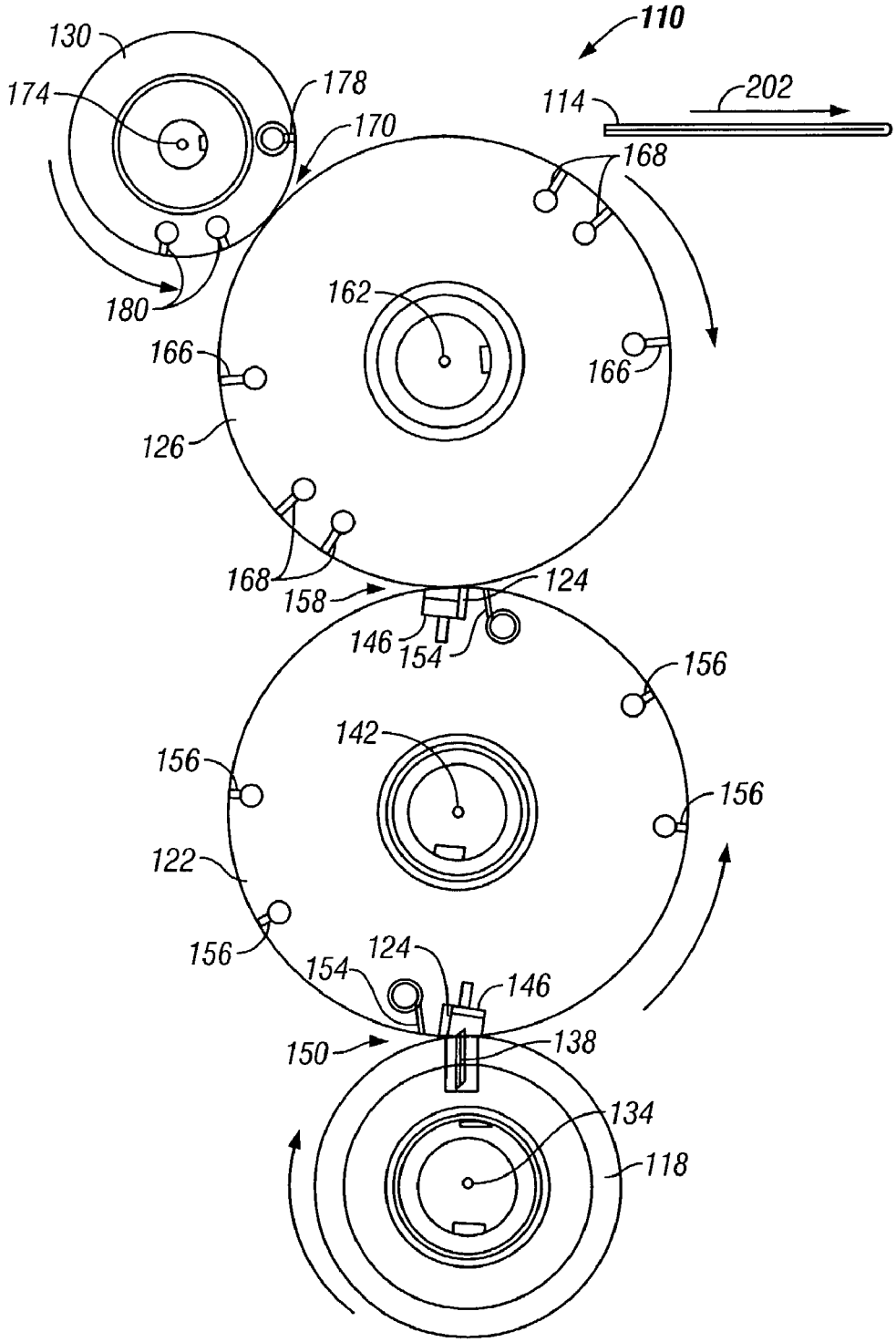
Figure 12B:
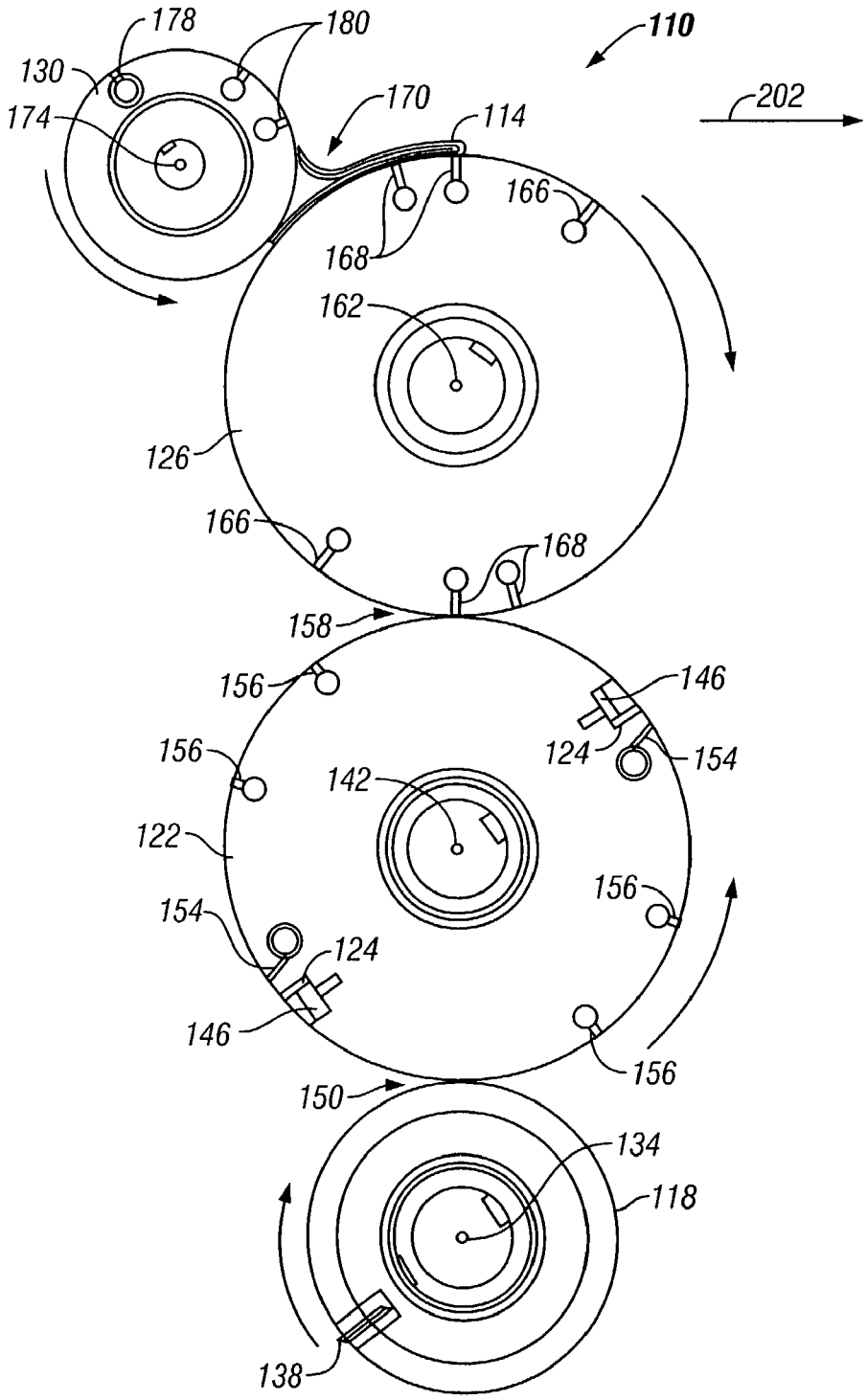
Figure 13:
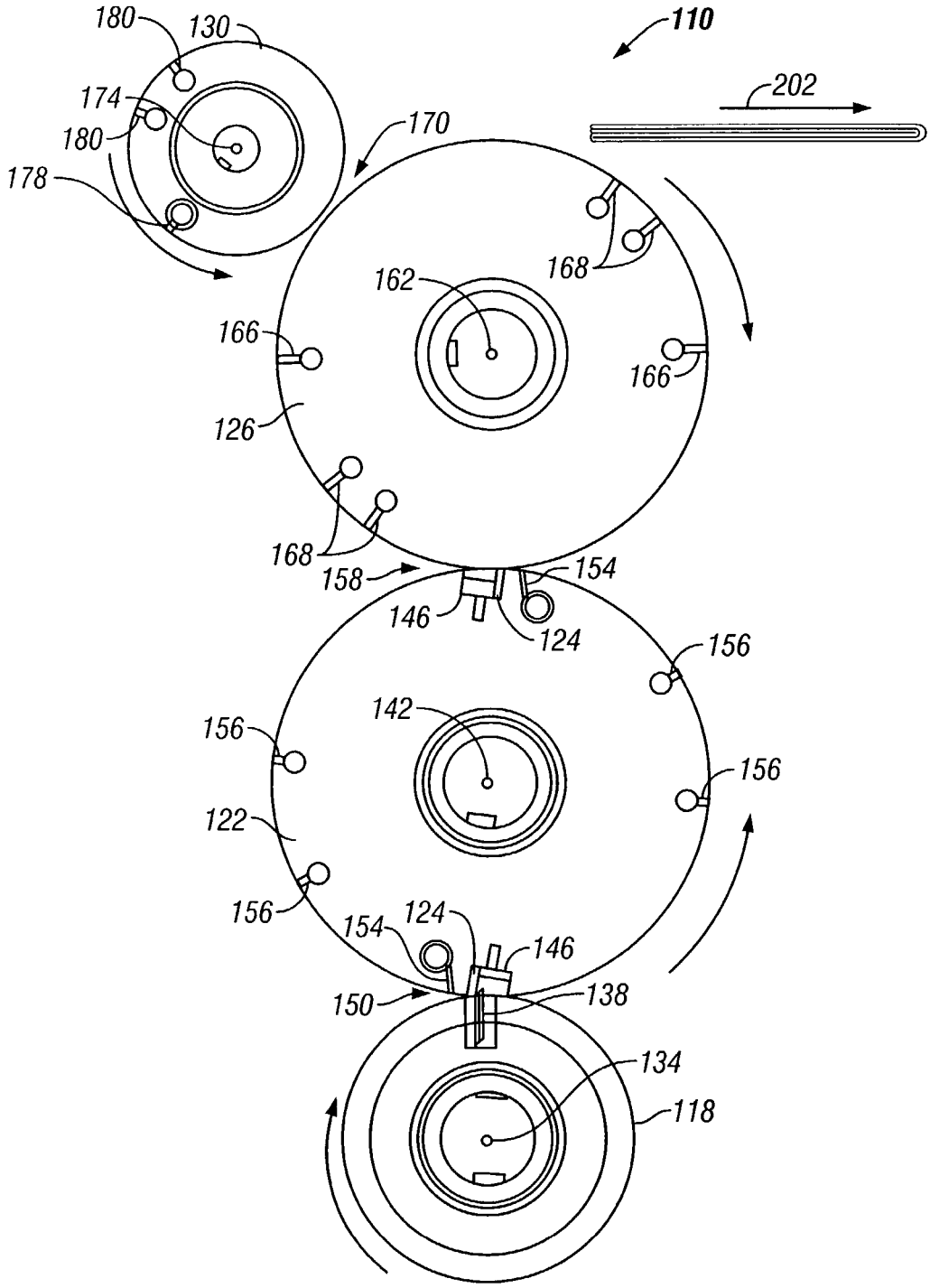

At a desired time or amount of rotation of the double transverse roll 130, vacuum to the vacuum port 178 on the double transverse roll 130 is cut off, while vacuum is either opened to additional (upstream) vacuum ports 166 on the single transverse roll 126 or continues to be exerted through such additional vacuum ports 166. As a result, the sheet 114 is drawn from the double transverse roll 130 onto the single transverse roll 126 as best shown in FIG. 12*b*, thereby generating another (double) transverse fold in the sheet 114. The single transverse roll 126 continues to rotate until the sheet 114 is conveyed between the belts 194, 198 (only one of which is shown in FIGS. 11*b* and 12*b*). FIG. 13 shows the sheet 114 with the double transverse fold as it is transferred toward the starwheel assembly 186 via the belts 194, 198. In the illustrated embodiment, the double transverse fold of the sheet 114 is generated at an off-center location of the sheet 114 (i.e., offset from the middle of the sheet 114). However, like the fold generated by the anvil and single transverse rolls 122, 126 as described above, this fold can be generated at any point of the sheet 114, for example, at the middle of the sheet 114 or offset on another side of the middle. Changes to the location of the double transverse fold can be made in any of the manners described above with regard to the single transverse fold as applied to the single and double transverse rolls 126, 130. After the folding process has been performed, the sheet 114 is transferred downstream for further processing (as discussed above).

In some embodiments of the present invention the folding assembly 210 can provide sheets 114 with a single transverse fold in another manner. Specifically, the folding assembly 210 can create single transverse folds with the single transverse roll 126 and the double transverse roll 130 as described above rather than with the anvil roll 118 and the single transverse roll 122. In this regard, the folding assembly 210 passes the sheet 114 through the single transverse nip 158 without providing the sheet 114 with the single transverse fold, such as by transferring the leading edge of the sheet 114 to the single transverse roll 122 rather than a portion of the sheet 114 between the leading and trailing edges of the sheet 114 as illustrated in the figures. Therefore, the sheet 114 arrives at the double transverse nip 170 without a fold. The single and double transverse rolls 126, 130 can then operate as described above (with reference to the production of a double-transverse fold) to provide the sheet 114 with a single transverse fold.

As described above and illustrated in the figures, the sheet 114 maintains contact with at least one of the rolls in the folding assembly 110 while the sheet 114 is being provided with either the single or single and double transverse folds. Also, it should be noted that the manner in which both types of folds are created in the folding assembly 110 of the present invention enables quick changeover between types of folded product run in the folder 20, and can even enable "on-the-fly" changeover between types of folded product based upon the ability of a user in some embodiments to change the manner in which vacuum is ported to the first and second transverse rolls 126, 130 without stopping the folder 20.

With reference again to FIGS. 1A and 1B, some embodiments of the folder 20 according to the present invention employ an improved arrangement of folder components that significantly simplifies assembly and maintenance of the folder 20. As mentioned in the Background above, conventional folders typically employ one or more assemblies that are located in a relatively high location requiring user access via ladders, personnel lifts, or other structures. This can significantly increase the costs associated with folder assembly, maintenance, and service.

In some embodiments of the present invention (including those illustrated in the figures), the folder 20 is designed so that the subassemblies and components of the folder 20 are positioned to provide a low folder profile. In this regard, a number of the folder subassembly and component arrangements invariably employed in conventional folders are dispensed with.

More particularly, in some embodiments the roll axis 32 of the unwind stand 28 and the single transverse roll axis 162 of the folding assembly 110 are positioned a first and second distance, respectively, from the ground surface 230. In some embodiments, the vertical distance between the roll axis 32 of the unwind stand 28 and the ground surface 230 is no greater than 1.3 times the distance between the roll axis 162 of the single transverse roll 126 and the ground surface 230 (wherein the ground surface 126 is a common or substantially common reference elevation). In other embodiments, the vertical distance between the roll axis 32 of the unwind stand 28 and the ground surface 230 is no greater than 1.2 times the distance between the roll axis 162 of the single transverse roll 126 and the ground surface 230. In still other embodiments, the vertical distance between the roll axis 32 of the unwind stand 28 and the ground surface 230 is no greater than 1.1 times the distance between the roll axis 162 of the single transverse roll 126 and the ground surface 230.

Similarly, in some embodiments the vertical distance between the roll axis 162 of the single transverse roll 126 and the ground surface 230 is no greater than the distance between the roll axis 32 of the unwind stand 28 and the ground surface 230. In other embodiments, the vertical distance between the roll axis 162 of the single transverse roll 126 and the ground surface 230 is no greater than 1.1 times the distance between the roll axis 32 of the unwind stand 28 and the ground surface 230. In still other embodiments, the vertical distance between the roll axis 162 of the single transverse roll 126 and the ground surface 230 is no greater than 1.2 times the distance between the roll axis 32 of the unwind stand 28 and the ground surface 230.

By employing the above-described height ratios between the roll axis 32 of the unwind stand 28 and the roll axis 162 of the single transverse roll 126, a relatively low-profile folder 20 providing significant assembly, maintenance, and service advantages.

In some embodiments of the present invention, the vertical distance between the roll axis 162 of the single transverse roll 126 and the ground surface 230 is no greater than the distance between the axis 189 of the starwheel assembly 186 and the ground surface 230. In other embodiments, the vertical distance between the roll axis 162 of the single transverse roll 126 and the ground surface 230 is no greater than 1.2 times the distance between the axis 189 of the starwheel assembly 186 and the ground surface 230. In still other embodiments, the vertical distance between the roll axis 162 of the single transverse roll 126 and the ground surface 230 is no greater than 1.5 times the distance between the axis 189 of the starwheel assembly 186 and the ground surface 230.

Like the above-described height relationship between the single transverse roll 126 and the unwind stand 28, employing the above-described height ratios between the axis 189 of the starwheel assembly 186 and the roll axis 162 of the single transverse roll 126 results in a relatively low-profile folder 20 providing significant assembly, maintenance, and service advantages.

In some embodiments of the present invention, the vertical distance between a top roll 66 of the embosser 62 and the ground surface 230 is no greater than 1.3 times the vertical distance between the roll axis 162 of the single transverse roll 126 and the ground surface 230. In other embodiments, the vertical distance between the top roll of the embosser 62 and the ground surface 230 is no greater than 0.9 times the vertical distance between the roll axis 162 of the single transverse roll 126 and the ground surface 230. In still other embodiments, the vertical distance between the top roll of the embosser 62 and the ground surface 230 is no greater than 0.8 times the vertical distance between the roll axis 162 of the single transverse roll 126 and the ground surface 230.

Also, in some embodiments of the present invention, the vertical distance between the axes of the creaser rolls 66 (and in some cases, the axis of at least one of the creaser rolls 66) and the ground surface 230 is no greater than 0.9 times the vertical distance between the roll axis 162 of the single transverse roll 126 and the ground surface 230. In other embodiments, the vertical distance between the axes of the creaser rolls 66 (and in some cases, the axis of at least one of the creaser rolls 66) and the ground surface 230 is no greater than 0.7 times the vertical distance between the roll axis 162 of the single transverse roll 126 and the ground surface 230. In still other embodiments, the vertical distance between the axes of the creaser rolls 66 (and in some cases, the axis of at least one of the creaser rolls 66) and the ground surface 230 is no greater than 0.5 times the vertical distance between the roll axis 162 of the single transverse roll 126 and the ground surface 230.

Regardless of whether employed in conjunction with the height relationships between the single transverse roll 126 and the unwind stand 28 and starwheel assembly 186 as described above, the above-described height relationships between the single transverse roll 126 and the top roll 66 of the embosser 62 and the creasers 66 can also provide significant assembly, maintenance, and service advantages. In addition, when employed in conjunction with a bottom-fed folding assembly 110 (e.g., when the web is supplied to the folding assembly 110 at a bottom location thereof) and/or with creasers 66 that are fed from above as shown in the figures, the profile of the folder 20 according to the present invention can be significantly reduced.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed is:

1. A folder, comprising:

a first folding roll having a blade for cutting a web of material into sheets;

a second folding roll having at least one vacuum port through which vacuum can be selectively supplied to retain the sheets on the second folding roll, the first and second folding rolls defining a first nip therebetween; and a third folding roll having at least one vacuum port through which vacuum can be selectively supplied to retain the sheets to the third folding roll, the second and third folding rolls defining a second nip therebetween, the first and second folding rolls rotatable to advance sheets from the first nip through the second nip, the first and second folding rolls rotatable to create folds in sheets passed through the first nip by vacuum selectively supplied to the at least one vacuum port in the second folding roll, and the second and third folding rolls rotatable to create folds in sheets passed through the second nip by vacuum selectively supplied to the vacuum ports in the second and third folding rolls, the folder having a first mode of operation in which vacuum is selectively supplied to the first, second, and third folding rolls to create a first fold in sheets passed through the first nip and a second fold in sheets passed through the second nip, and a second mode of operation in which a single fold is created in sheets passed through the first and second nips where the first folding roll rotates about a first axis, the second folding roll rotates about a second axis, and the third folding roll rotates about a third axis, the second axis being disposed at a higher elevation than the first axis, and the third axis being disposed at a higher elevation than the second axis.

2. The folder as claimed in claim 1, further comprising a fourth roll having a blade cooperating with the first folding roll to cut the web of material into sheets.

3. The folder as claimed in claim 1, wherein the first folding roll has at least one vacuum port through which vacuum can be selectively supplied to retain the sheets to the first folding roll.

4. The folder as claimed in claim 1, wherein sheets passing through the second nip remain on the second folding roll without transferring to the third folding roll in the second mode of operation.

5. The folder as claimed in claim 1, wherein vacuum is selectively supplied to the first and second folding rolls to create folds in sheets passing through the first and second folding rolls in the first mode of operation.

6. The folder as claimed in claim 5, wherein vacuum is selectively supplied to the first and second folding rolls to create folds in sheets passing through the first and second folding rolls in the second mode of operation.

7. The folder as claimed in claim 1, wherein vacuum is supplied through the at least one port in the third folding roll only in the first mode of operation.

8. The folder as claimed in claim 1, wherein the second and third axes are substantially vertically aligned.

9. The folder as claimed in claim 1, wherein the first, second, and third folding rolls at least partially define a set of folding rolls arranged to receive the web at a bottom location of the set of folding rolls and to discharge the web at a top location of the set of folding rolls.

10. The folder as claimed in claim 1, wherein vacuum supplied to the second folding roll is adjustable to change a location of folds created by the first and second folding rolls in sheets passing through the first nip.

11. The folder as claimed in claim 1, wherein vacuum supplied to the third folding roll is adjustable to change a location of folds created by the second and third folding rolls in sheets passing through the second nip.

12. A folder for folding a sheet of material, the folder comprising:

a first folding roll rotatable about a first axis;

a second folding roll adjacent to the first folding roll and rotatable about a second axis, the first and second folding rolls defining a first nip therebetween;

a first valve operable to selectively supply vacuum to a surface of the second folding roll to draw the sheet of material to the second folding roll, the sheet at least partially transferable from the first folding roll to the second folding roll to provide the sheet with a first fold;

a third folding roll adjacent to the second folding roll and rotatable about a third axis, the second and third folding rolls defining a second nip therebetween; and a second valve operable to selectively supply vacuum to a surface of the third folding roll to draw the sheet of material to the third folding roll, the sheet at least partially transferable from the second folding roll to the third folding roll to provide the sheet with a second fold, the second valve controllable to draw the sheet from the second roll in a first state and to leave the sheet on the second roll in a second state wherein the second axis is disposed at a a higher elevation than the first axis, and the third axis being disposed at a higher elevation than the second axis.

13. The folder as claimed in claim 12, further comprising a fourth folding roll adjacent to the first folding roll and rotatable about a fourth axis, the fourth folding roll having a blade positioned to cut and create the sheet in rotation of the fourth folding roll.

14. The folder as claimed in claim 12, further comprising a third valve operable to selectively supply vacuum to a surface of the first folding roll to draw the sheet of material to the first folding roll.

15. The folder as claimed in claim 12, wherein the sheet passing through the second nip remains on the second folding roll without transferring to the third folding roll in the second state.

16. The folder as claimed in claim 12, wherein vacuum is selectively supplied to the first and second folding rolls to create folds in sheets passing through the first and second folding rolls in the first state.

17. The folder as claimed in claim 16, wherein vacuum is selectively supplied to the first and second folding rolls to create folds in sheets passing through the first and second folding rolls in the second state.

18. The folder as claimed in claim 12, wherein vacuum is supplied to the surface of the third folding roll only in the first state.

19. The folder as claimed in claim 12, wherein the second and third axes are substantially vertically aligned.

20. The folder as claimed in claim 12, wherein the first, second, and third folding rolls at least partially define a set of folding rolls arranged to receive the sheet at a bottom location of the set of folding rolls and to discharge the sheet at a top location of the set of folding rolls.

21. The folder as claimed in claim 12, wherein vacuum supplied to the surface of the second folding roll is adjustable to change a location of folds created by the first and second folding rolls in the sheet passing through the first nip.

22. The folder as claimed in claim 12, wherein vacuum supplied to the surface of the third folding roll is adjustable to change a location of folds created by the second and third folding rolls in the sheet passing through the second nip.

23. A folder for folding a sheet of material, the folding comprising:

a first folding roll;

a second folding roll adjacent the first folding roll;

a third folding roll adjacent the second folding roll;

a first nip defined between the first and second folding rolls;

a second nip defined between the second and third folding rolls;

a first vacuum valve coupled to the second folding roll and operable to selectively supply vacuum to a surface of the second folding roll;

a second vacuum valve coupled to the third folding roll and operable to selectively supply vacuum to a surface of the third folding roll;

the folder having a first state in which vacuum is supplied by the first vacuum valve to the second folding roll to generate sheets having single transverse folds exiting the folder, and a second state in which vacuum is supplied by the first and second vacuum valves to the second and third folding rolls, respectively, to generate sheets having double transverse folds exiting the folder wherein the first folding roll rotates about a first axis, the second folding roll rotates about a second axis, and the third folding roll rotates about a third axis, the second axis being disposed at a higher elevation than the first axis, and the third being disposed at a higher elevation than the second axis.

24. A method of folding sheets of material, the method comprising:

retaining sheets upon a surface of a first folding roll;

advancing the sheets upon the surface of the first folding roll to a first nip defined between the first folding roll and a second folding roll adjacent the first folding roll;

supplying vacuum to a surface of the second folding roll;

transferring the sheets from the first folding roll to the second folding roll via the vacuum supplied to the surface of the second folding roll;

folding each sheet by transferring the sheets from the first folding roll to the second folding roll;

advancing the folded sheets upon the surface of the second folding roll to a second nip defined between the second folding roll and a third folding roll;

passing the folded sheets through the second nip between the second folding roll and the third folding roll, the folded sheets being retained on the second folding roll without being drawn to the third folding roll;

supplying vacuum to a surface of the third folding roll;

drawing other sheets from the second folding roll to the third folding roll;

releasing the other sheets from the third folding roll; and folding each of the other sheets by drawing and releasing the other sheets by the third folding roll wherein the first folding roll rotates about a first axis, the second folding roll rotates about a second axis, and the third folding roll rotates about a third axis, the second axis being disposed at a higher elevation than the first axis, and the third axis being disposed at a higher elevation than the second axis, the method further comprising advancing sheets from an elevation at the first nip to a higher elevation at the second nip.

25. The method as claimed in claim 24, further comprising cutting the sheets from web material prior to advancing the sheets upon the surface of the first folding roll.

26. The method as claimed in claim 24, further comprising supplying vacuum to the surface of the first folding roll while advancing the sheets upon the surface of the first folding roll.

27. The method as claimed in claim 26, wherein the second and third axes are substantially vertically aligned, and wherein advancing sheets from an elevation at the first nip to a higher elevation at the second nip further includes advancing sheets from an elevation at the first nip to a higher elevation at the second nip disposed substantially vertically over the first nip wherein the first folding roll rotates about a first axis, the second folding roll rotates about a second axis, and the third folding roll rotates about a third axis, the second axis being disposed at a higher elevation than the first axis, and the third axis being disposed at a higher elevation than the second axis, the method further comprising advancing sheets from an elevation at the first nip to a higher elevation at the second nip.

28. The method as claimed in claim 24, further comprising:

feeding web material to the first folding roll at a first elevation; and discharging sheets from the third folding roll at a second elevation higher than the first elevation.

29. The method as claimed in claim 24, further comprising:

adjusting timing of vacuum supplied to the surface of the second folding roll; and changing locations of folds in the sheets by adjusting timing of vacuum supplied to the surface of the second folding roll.

30. The method as claimed in claim 24, further comprising:

adjusting timing of vacuum supplied to the surface of the third folding roll; and changing locations of folds in the other sheets by adjusting timing of vacuum supplied to the surface of the third folding roll.

31. A method of folding sheets of material, the method comprising:

retaining sheets upon a surface of a first folding roll;

advancing the sheets upon the surface of the first folding roll to a first nip defined between the first folding roll and a second folding roll adjacent the first folding roll;

supplying vacuum to a surface of the second folding roll;

transferring the sheets from the first folding roll to the second folding roll via the vacuum supplied to the surface of the second folding roll, the sheets being transferred to the second folding roll without folding the sheets;

advancing the sheets upon the surface of the second folding roll to a second nip defined between the second folding roll and a third folding roll;

supplying vacuum to a surface of the third folding roll;

drawing the sheets from the second folding roll to the third folding roll;

releasing the sheets from the third folding roll;

folding each of the sheets by drawing and releasing the sheets by the third folding roll;

supplying vacuum to the surface of the first folding roll;

transferring other sheets from the first folding roll to the second folding roll via the vacuum supplied to the surface of the second folding roll;

folding each of the other sheets by transferring the other sheets from the first folding roll to the second folding roll;

advancing the other sheets upon the surface of the second folding roll to the second nip between the second folding roll and the third folding roll;

supplying vacuum to the surface of the third folding roll;

drawing the other sheets from the second folding roll to the third folding roll;

releasing the other sheets from the third folding roll; and folding each of the other sheets again by drawing and releasing the sheets by the third folding roll.

32. The method as claimed in claim 31, further comprising cutting the sheets from web material prior to advancing the sheets upon the surface of the first folding roll.

33. The method as claimed in claim 31, further comprising supplying vacuum to the surface of the first folding roll while advancing the sheets upon the surface of the first folding roll.

34. The method as claimed in claim 31, wherein the second and third axes are substantially vertically aligned, and wherein advancing sheets from an elevation at the first nip to a higher elevation at the second nip further includes advancing sheets from an elevation at the first nip to a higher elevation at the second nip disposed substantially vertically over the first nip.

35. The method as claimed in claim 31, further comprising:

feeding web material to the first folding roll at a first elevation; and discharging sheets from the third folding roll at a second elevation higher than the first elevation.

36. The method as claimed in claim 31, further comprising:

adjusting timing of vacuum supplied to the surface of the second folding roll; and changing locations of folds in the sheets by adjusting timing of vacuum supplied to the surface of the second folding roll.

37. The method as claimed in claim 31, further comprising:

adjusting timing of vacuum supplied to the surface of the third folding roll; and changing locations of folds in the other sheets by adjusting timing of vacuum supplied to the surface of the third folding roll.

* * * * *